US009567685B2

(12) United States Patent
Kagajwala et al.

(10) Patent No.: US 9,567,685 B2
(45) Date of Patent: Feb. 14, 2017

(54) APPARATUS AND METHOD FOR DYNAMIC CONTROL OF PLATED UNIFORMITY WITH THE USE OF REMOTE ELECTRIC CURRENT

(71) Applicant: Lam Research Corporation, Fremont, CA (US)

(72) Inventors: Burhanuddin Kagajwala, Hillsboro, OR (US); Bryan L. Buckalew, Tualatin, OR (US); Steven T. Mayer, Lake Oswego, OR (US); Lee Peng Chua, Beaverton, OR (US); Aaron Berke, Portland, OR (US); James Isaac Fortner, Newberg, OR (US); Robert Rash, West Linn, OR (US)

(73) Assignee: Lam Research Corporation, Fremont, CA (US)

( * ) Notice: Subject to any disclaimer, the term of this patent is extended or adjusted under 35 U.S.C. 154(b) by 86 days.

(21) Appl. No.: 14/602,910

(22) Filed: Jan. 22, 2015

(65) Prior Publication Data

US 2016/0215408 A1 Jul. 28, 2016

(51) Int. Cl.
*C25D 17/02* (2006.01)
*C25D 5/04* (2006.01)
(Continued)

(52) U.S. Cl.
CPC ..... *C25D 5/04* (2013.01); *C25D 17/001* (2013.01); *C25D 17/002* (2013.01);
(Continued)

(58) Field of Classification Search
None
See application file for complete search history.

(56) References Cited

U.S. PATENT DOCUMENTS 3,880,725 A 4/1975 Van Raalte et al.
4,304,641 A 12/1981 Grandia et al.
(Continued)

FOREIGN PATENT DOCUMENTS

CA 1 236 627 7/1986
CN 1531028 A 9/2004
(Continued)

OTHER PUBLICATIONS

US Office Action, dated May 26, 2010, issued in U.S. Appl. No. 11/506,054.
(Continued)

*Primary Examiner* — Harry D Wilkins, III
(74) *Attorney, Agent, or Firm* — Weaver Austin Villeneuve & Sampson LLP

(57) ABSTRACT

An apparatus for electroplating metal on a substrate while controlling plating uniformity includes in one aspect: a plating chamber having anolyte and catholyte compartments separated by a membrane; a primary anode positioned in the anolyte compartment; an ionically resistive ionically permeable element positioned between the membrane and a substrate in the catholyte compartment; and a secondary electrode configured to donate and/or divert plating current to and/or from the substrate, wherein the secondary electrode is positioned such that the donated and/or diverted plating current does not cross the membrane separating the anolyte and catholyte compartments, but passes through the ionically resistive ionically permeable element. In some embodiments the secondary electrode is an azimuthally symmetrical anode (e.g., a ring positioned in a separate compartment around the periphery of the plating chamber) that can be dynamically controlled during electroplating.

18 Claims, 12 Drawing Sheets

(51) Int. Cl.

| | |
|---|---|
| ***C25D 17/00*** | (2006.01) |
| ***C25D 17/06*** | (2006.01) |
| ***C25D 17/10*** | (2006.01) |
| ***C25D 17/12*** | (2006.01) |
| *C25D 7/12* | (2006.01) |

(52) U.S. Cl.

CPC ..... *C25D 17/007* (2013.01); *C25D 17/008* (2013.01); *C25D 17/06* (2013.01); *C25D 17/10* (2013.01); *C25D 17/12* (2013.01); *C25D 7/123* (2013.01)

(56) References Cited

U.S. PATENT DOCUMENTS

| | | | | |
|---|---|---|---|---|
| 4,696,729 | A | 9/1987 | Santini | |
| 5,078,852 | A | 1/1992 | Yee et al. | |
| 5,169,684 | A | 12/1992 | Takagi | |
| 5,312,352 | A | 5/1994 | Leschinsky et al. | |
| 5,312,532 | A | 5/1994 | Andricacos et al. | |
| 5,620,581 | A | 4/1997 | Ang | |
| 5,723,028 | A | 3/1998 | Poris | |
| 5,774,019 | A | 6/1998 | Koyama et al. | |
| 6,004,440 | A | 12/1999 | Hanson et al. | |
| 6,027,631 | A | 2/2000 | Broadbent | |
| 6,071,388 | A | 6/2000 | Uzoh | |
| 6,074,544 | A | 6/2000 | Reid et al. | |
| 6,099,702 | A | 8/2000 | Reid et al. | |
| 6,106,687 | A | 8/2000 | Edelstein | |
| 6,110,346 | A | 8/2000 | Reid et al. | |
| 6,126,798 | A | 10/2000 | Reid et al. | |
| 6,132,587 | A | 10/2000 | Jorne et al. | |
| 6,132,805 | A | 10/2000 | Moslehi | |
| 6,156,167 | A | 12/2000 | Patton et al. | |
| 6,162,344 | A | 12/2000 | Reid et al. | |
| 6,168,693 | B1 | 1/2001 | Uzoh et al. | |
| 6,174,425 | B1 | 1/2001 | Simpson et al. | |
| 6,179,983 | B1 | 1/2001 | Reid et al. | |
| 6,193,860 | B1 | 2/2001 | Weling | |
| 6,228,231 | B1 | 5/2001 | Uzoh | |
| 6,261,433 | B1 | 7/2001 | Landau | |
| 6,322,674 | B1 | 11/2001 | Berner et al. | |
| 6,391,166 | B1 | 5/2002 | Wang | |
| 6,402,923 | B1 | 6/2002 | Mayer et al. | |
| 6,425,991 | B1 * | 7/2002 | Tran | H01L 21/2885 204/224 R |
| 6,497,801 | B1 | 12/2002 | Woodruff et al. | |
| 6,527,920 | B1 | 3/2003 | Mayer et al. | |
| 6,551,483 | B1 | 4/2003 | Mayer et al. | |
| 6,569,299 | B1 | 5/2003 | Reid et al. | |
| 6,599,412 | B1 | 7/2003 | Graham et al. | |
| 6,627,051 | B2 | 9/2003 | Berner et al. | |
| 6,632,335 | B2 | 10/2003 | Matsuda et al. | |
| 6,716,334 | B1 | 4/2004 | Reid et al. | |
| 6,755,954 | B2 | 6/2004 | Mayer et al. | |
| 6,773,571 | B1 | 8/2004 | Mayer et al. | |
| 6,800,187 | B1 | 10/2004 | Reid et al. | |
| 6,843,894 | B2 | 1/2005 | Berner et al. | |
| 6,919,010 | B1 | 7/2005 | Mayer et al. | |
| 6,988,932 | B2 | 1/2006 | Ashjaee et al. | |
| 7,288,177 | B2 | 10/2007 | Barrese et al. | |
| 7,323,094 | B2 | 1/2008 | Simpson et al. | |
| 7,383,521 | B2 | 6/2008 | Smith et al. | |
| 7,622,024 | B1 | 11/2009 | Mayer et al. | |
| 7,682,498 | B1 | 3/2010 | Mayer et al. | |
| 7,737,035 | B1 | 6/2010 | Lind et al. | |
| 7,837,841 | B2 | 11/2010 | Chen et al. | |
| 7,854,828 | B2 | 12/2010 | Reid et al. | |
| 7,967,969 | B2 | 6/2011 | Mayer et al. | |
| 8,262,871 | B1 * | 9/2012 | Mayer | C25D 17/008 204/242 |
| 8,308,931 | B2 | 11/2012 | Reid et al. | |
| 8,475,636 | B2 | 7/2013 | Mayer et al. | |
| 8,475,637 | B2 | 7/2013 | Feng et al. | |
| 8,475,644 | B2 | 7/2013 | Mayer et al. | |
| 8,603,305 | B2 | 12/2013 | Rash et al. | |
| 8,795,480 | B2 | 8/2014 | Mayer et al. | |
| 8,858,774 | B2 | 10/2014 | Mayer et al. | |
| 9,260,793 | B2 | 2/2016 | Mayer et al. | |
| 9,309,604 | B2 | 4/2016 | Mayer et al. | |
| 2002/0017456 | A1 | 2/2002 | Graham et al. | |
| 2002/0020627 | A1 | 2/2002 | Kunisawa et al. | |
| 2002/0119671 | A1 | 8/2002 | Lee | |
| 2002/0125141 | A1 | 9/2002 | Wilson et al. | |
| 2003/0038035 | A1 | 2/2003 | Wilson et al. | |
| 2003/0079995 | A1 | 5/2003 | Contolini et al. | |
| 2003/0201166 | A1 | 10/2003 | Zheng et al. | |
| 2004/0084316 | A1 | 5/2004 | Muranaka | |
| 2004/0094427 | A1 | 5/2004 | Economikos et al. | |
| 2004/0149584 | A1 | 8/2004 | Nagai et al. | |
| 2005/0145499 | A1 | 7/2005 | Kovarsky et al. | |
| 2005/0164498 | A1 | 7/2005 | Ide et al. | |
| 2006/0201814 | A1 * | 9/2006 | Hafezi | C25D 5/04 205/102 |
| 2006/0243598 | A1 | 11/2006 | Singh et al. | |
| 2007/0029193 | A1 | 2/2007 | Brcka | |
| 2008/0179180 | A1 * | 7/2008 | McHugh | C25D 7/12 204/164 |
| 2010/0032303 | A1 | 2/2010 | Reid et al. | |
| 2010/0032304 | A1 | 2/2010 | Mayer et al. | |
| 2010/0032310 | A1 | 2/2010 | Reid et al. | |
| 2010/0044236 | A1 | 2/2010 | Mayer et al. | |
| 2010/0116672 | A1 | 5/2010 | Mayer et al. | |
| 2012/0000786 | A1 | 1/2012 | Mayer et al. | |
| 2012/0061246 | A1 * | 3/2012 | Feng | C25D 17/001 205/157 |
| 2012/0258408 | A1 | 10/2012 | Mayer et al. | |
| 2013/0137242 | A1 | 5/2013 | He et al. | |
| 2013/0313123 | A1 | 11/2013 | Abraham et al. | |
| 2013/0327650 | A1 | 12/2013 | Mayer et al. | |
| 2014/0144781 | A1 | 5/2014 | He | |
| 2014/0231245 | A1 | 8/2014 | Sandmann et al. | |
| 2015/0060291 | A1 | 3/2015 | Mayer et al. | |
| 2016/0115611 | A1 | 4/2016 | Mayer et al. | |
| 2016/0177466 | A1 | 6/2016 | Kagajawala et al. | |

FOREIGN PATENT DOCUMENTS

| | | | |
|---|---|---|---|
| CN | 1624207 | A | 6/2005 |
| CN | 1705774 | A | 12/2005 |
| CN | 101056718 | A | 10/2007 |
| CN | 100487855 | C | 5/2009 |
| CN | 101736376 | A | 6/2010 |
| EP | 1179617 | A1 | 2/2002 |
| JP | 2003-268591 | | 9/2003 |
| KR | 10-0707121 | | 4/2007 |
| TW | 223678 | | 11/2004 |
| TW | 201107536 | A | 3/2011 |
| WO | WO 99/14401 | | 3/1999 |
| WO | WO 99/64647 | | 12/1999 |
| WO | WO 2005/043593 | | 5/2005 |
| WO | WO 2010/144330 | | 12/2010 |

OTHER PUBLICATIONS

US Notice of Allowance, dated Aug. 13, 2010, issued in U.S. Appl. No. 11/506,054.

US Office Action, dated Sep. 19, 2011, issued in U.S. Appl. No. 12/291,356.

US Final Office Action, dated Feb. 27, 2012, issued in U.S. Appl. No. 12/291,356.

US Notice of Allowance, dated Jul. 27, 2012, issued in U.S. Appl. No. 12/291,356.

US Office Action, dated Jun. 24, 2011, issued in U.S. Appl. No. 12/481,503.

US Final Office Action, dated Mar. 1, 2012, issued in U.S. Appl. No. 12/481,503.

US Office Action, dated Jul. 9, 2012, issued in U.S. Appl. No. 12/481,503.

US Final Office Action, dated Dec. 19, 2012, issued in U.S. Appl. No. 12/481,503.

(56) References Cited

OTHER PUBLICATIONS

US Notice of Allowance dated Mar. 1, 2013 issued in U.S. Appl. No. 12/481,503.
US Office Action, dated Jun. 24, 2011, issued in U.S. Appl. No. 12/606,030.
US Final Office Action, dated Mar. 1, 2012, issued in U.S. Appl. No. 12/606,030.
US Office Action, dated Jun. 28, 2012, issued in U.S. Appl. No. 12/606,030.
US Office Action, dated Jul. 13, 2012, issued in U.S. Appl. No. 12/606,030.
US Final Office Action, dated Dec. 17, 2012, issued in U.S. Appl. No. 12/606,030.
US Notice of Allowance dated Mar. 1, 2013 issued in U.S. Appl. No. 12/606,030.
US Office Action, dated Feb. 25, 2014, issued in U.S. Appl. No. 13/438,443.
US Notice of Allowance, dated Jun. 11, 2014, issued in U.S. Appl. No. 13/438,443.
Chinese First Office Action dated May 15, 2013 issued in CN Application No. 200910209697.2.
Chinese Second Office Action dated Dec. 10, 2013 issued in CN Application No. 200910209697.2.
PCT International Search Report and Written Opinion, dated Jan. 12, 2011, issued in PCT/US2010/037520.
PCT International Preliminary Report on Patentability and Written Opinion, dated Dec. 22, 2011, issued in PCT/US2010/037520.
Chinese First Office Action dated Nov. 6, 2013 issued in CN Application No. 201080032109.3.
Chinese Second Office Action dated Jun. 10, 2014 issued in CN Application No. 201080032109.3.
Taiwan Office Action dated Jul. 31, 2014 issued in TW Application No. 099118603.
US Office Action, dated Jul. 29, 2015, issued in U.S. Appl. No. 13/907,265.
US Notice of Allowance, dated Dec. 30, 2015, issued in U.S. Appl. No. 13/907,265.
US Notice of Allowance, dated Oct. 2, 2015, issued in U.S. Appl. No. 14/483,942.
US Notice of Allowance [Corrected Notice of Allowability], dated Nov. 10, 2015, issued in U.S. Appl. No. 14/483,942.
US Notice of Allowance [Corrected Notice of Allowability], dated Jan. 20, 2016, issued in U.S. Appl. No. 14/483,942.
US Office Action, dated Jan. 15, 2016, issued in U.S. Appl. No. 13/687,937.
Korean First Office Action dated Jun. 23, 2016 issued in KR 10-2012-7000614.
Chinese First Office Action dated Oct. 13, 2015 issued in CN 201210098129.1.
Chinese Second Office Action dated Jun. 6, 2016 issued in CN 201210098129.1.
Taiwan Office Action dated Nov. 10, 2015 issued in TW USSN 101111926.
Taiwan Office Action dated Aug. 2, 2016 issued in TW 101144354.

* cited by examiner

APPARATUS AND METHOD FOR DYNAMIC CONTROL OF PLATED UNIFORMITY WITH THE USE OF REMOTE ELECTRIC CURRENT

FIELD OF THE INVENTION

The present disclosure relates generally to a method and apparatus for electroplating a metal layer on a semiconductor wafer. More particularly, the method and apparatus described herein are useful for controlling plating uniformity.

BACKGROUND

The transition from aluminum to copper in integrated circuit (IC) fabrication required a change in process "architecture" (to damascene and dual-damascene) as well as a whole new set of process technologies. One process step used in producing copper damascene circuits is the formation of a "seed-" or "strike-" layer, which is then used as a base layer onto which copper is electroplated ("electrofill"). The seed layer carries the electrical plating current from the edge region of the wafer (where electrical contact is made) to all trenches and via structures located across the wafer surface. The seed film is typically a thin conductive copper layer, though other conductive materials can be used depending on application. It is separated from the insulating silicon dioxide or other dielectric by a barrier layer. The seed layer deposition process should yield a layer which has good overall adhesion, excellent step coverage (more particularly, conformal and continuous layers of metal should be deposited onto the sidewalls of an embedded recessed feature), and minimal closure or "necking" of the top of the embedded recessed feature.

Market trends of increasingly smaller features and alternative seeding processes drive the need for a capability to plate with a high degree of uniformity on increasingly thin seed layers. In the future, it is anticipated that the seed film may simply be composed of a plateable barrier film, such as ruthenium, or a bilayer of a very thin barrier and copper (deposited, for example, by an atomic layer deposition (ALD) or similar process). Such films present the engineer with an extreme terminal effect situation. For example, when driving a 3 ampere total current uniformly into a 30 ohm per square ruthenium seed layer (a likely value for a 30-50 Å film) the resultant center to edge (radial) voltage drop in the metal will be over 2 volts. To effectively plate a large surface area, the plating tool makes electrical contact to the conductive seed only in the edge region of the wafer substrate. There is no direct contact made to the central region of the substrate. Hence, for highly resistive seed layers, the potential at the edge of the layer is significantly greater than at the central region of the layer. Without appropriate means of resistance and voltage compensation, this large edge-to-center voltage drop could lead to an extremely non-uniform plating rate and non-uniform plating thickness distribution, primarily characterized by thicker plating at the wafer edge. This plating non-uniformity is radial non-uniformity, that is, uniformity variation along a radius of the circular wafer.

Another type of non-uniformity, which needs to be mitigated, is azimuthal non-uniformity. For clarity, we define azimuthal non-uniformity, using polar coordinates, as thickness variations exhibited at different angular positions on the workpiece at a fixed radial position from the wafer center, that is, a non-uniformity along a given circle or portion of a circle within the perimeter of the wafer. This type of non-uniformity can be present in electroplating applications, independently of radial non-uniformity, and in some applications may be the predominant type of non-uniformity that needs to be controlled. It often arises in through resist plating, where a major portion of the wafer is masked with a photoresist coating or similar plating-preventing layer, and the masked pattern of features or feature densities are not azmuthally uniform near the wafer edge. For example, in some cases there may be a technically required chord region of missing pattern features near the notch of the wafer to allow for wafer numbering or handling. The radially and azimuthally variable plating rates inside missing region may cause chip die to be non-functional, therefore methods and apparatus for avoiding this situation are needed.

Electrochemical deposition is now poised to fill a commercial need for sophisticated packaging and multichip interconnection technologies known generally as wafer level packaging (WLP) and through silicon via (TSV) electrical connection technology. These technologies present their own very significant challenges.

Generally, the processes of creating TSV are loosely akin to damascene processing but are conducted at a different, larger size scale and utilize higher aspect ratio recessed features. In TSV processing a cavity or a recess is first etched into a dielectric layer (e.g. a silicon dioxide layer); then both the internal surface of the recessed feature and the field region of the substrate are metallized with a diffusion barrier and/or adhesion (stick) layer (e.g. Ta, Ti, TiW, TiN, TaN, Ru, Co, Ni, W), and an "electroplateable seed layer" (e.g. Cu, Ru, Ni, Co, that can be deposited for example by physical vapor deposition (PVD), chemical vapor deposition (CVD), ALD, or electroless plating processes). Next, the metallized recessed features are filled with metal, using, for example, "bottom up" copper electroplating. In contrast, through resist WLP feature formation typically proceeds differently. The process typically starts with a substantially planar substrate that may include some low aspect ratio vias or pads. The substantially planar dielectric substrate is coated with an adhesion layer followed by a seed layer (typically deposited by PVD). Then a photoresist layer is deposited and patterned over the seed layer to create a pattern of open areas, free of plating-masking photoresist in which the seed layer is exposed. Next, metal is electroplated into the open areas to from a pillar, line, or another feature on the substrate, which, after stripping of the photoresist, and removal of the seed layer by etching, leaves various electrically isolated embossed structures over the substrate.

Both of these technologies (TSV and through resist plating) require electroplating on a significantly larger size scale than damascene applications. Depending on the type and application of the packaging features (e.g. through chip connecting TSV, interconnection redistribution wiring, or chip to board or chip bonding, such as flip-chip pillars), plated features are usually, in current technology, greater than about 2 micrometers in diameter and typically are 5-100 micrometers in diameter (for example, pillars may be about 50 micrometers in diameter). For some on-chip structures such as power busses, the feature to be plated may be larger than 100 micrometers. The aspect ratios of the through resist WLP features are typically about 2:1 (height to width) or lower, more typically 1:1 or lower, while TSV structures can have very high aspect ratios (e.g., in the neighborhood of about 10:1 or 20:1).

Given the relatively large amount of material to be deposited, not only feature size, but also plating speed differentiates WLP and TSV applications from damascene applications. For many WLP applications, plating must fill features at a rate of at least about 2 micrometers/minute, and typically at least about 4 micrometers/minute, and for some applications at least about 7 micrometers/minute. The actual rates will vary depending on the particular metal being deposited. But at these higher plating rate regimes, efficient mass transfer of metal ions in the electrolyte to the plating surface is very important. Higher plating rates present numerous challenges with respect to maintaining suitable feature shape, as well as controlling the die and wafer scale thickness uniformity.

Another uniformity control challenge is presented by dissimilar substrates that may need to be sequentially processed in one electroplating tool. For example, two different semiconductor in-process wafers, each targeted for a different product, may have a substantially different radial distribution of recessed features near the edge region of the semiconductor wafer, and therefore would require different compensations to achieve the desired uniformity for both. Therefore, there is a need for an electroplating apparatus that will be capable to sequentially process dissimilar substrates with excellent plating uniformity and minimal plating tool downtime.

SUMMARY OF THE INVENTION

Described are method and apparatus for electroplating metal on a substrate while controlling plating non-uniformity, such as radial non-uniformity, azimuthal non-uniformity or both. Apparatus and methods described herein can be used for electroplating on a variety of substrates, including semiconductor wafer substrates having TSV or WLP recessed features. The apparatus and methods are particularly useful for sequential plating of metal on dissimilar substrates, because the apparatus is designed to allow for radial and/or azimuthal uniformity control and can accommodate a wide range of differences in substrates without hardware changes. Therefore, downtime of an electroplating tool that processes dissimilar substrates can be substantially reduced.

In a first aspect of the invention, an electroplating apparatus for electroplating a metal on a substrate is provided, wherein the apparatus includes: (a) a plating chamber configured to contain an electrolyte (which contains metal ions and usually an acid), the plating chamber comprising a catholyte compartment and an anolyte compartment, wherein the anolyte compartment and the catholyte compartment are separated by an ion-permeable membrane (wherein the membrane in some embodiments allows metal ion migration from anolyte to catholyte through the membrane under electromotive force, but substantially prevents elecrtrolyte flow and metal ion convective transport across the membrane); (b) a substrate holder configured to hold and rotate the substrate in the catholyte compartment during electroplating; (c) a primary anode positioned in the anolyte compartment of the plating chamber; (d) an ionically resistive ionically permeable element positioned between the ion-permeable membrane and the substrate holder, wherein the ionically resistive ionically permeable element is adapted to provide ionic transport through the element during electroplating; and (e) a secondary electrode configured to donate and/or divert plating current (also referred to here as ionic current) to and/or from the general periphery of the substrate, wherein the secondary electrode is positioned such that the donated and/or diverted plating current does not cross the ion-permeable membrane separating the anolyte and catholyte compartments, and wherein the secondary electrode is positioned such as to donate and/or divert plating current through the ionically resistive ionically permeable element.

In some embodiments the secondary electrode is an azimuthally symmetrical anode configured to donate plating current to the substrate. For example, the secondary anode may have a generally annular shape. The secondary anode may be an inert anode or a consumable (active) anode (e.g., a consumable anode comprising copper). In some embodiments the secondary anode may be positioned in a secondary anode compartment, around the periphery of the plating chamber, wherein the secondary anode compartment may be separated from the catholyte compartment by an ion-permeable membrane. In other embodiments, a membrane for separating the secondary anode from catholyte and from the substrate is not used. In some embodiments the apparatus comprises one or more channels for irrigating the secondary anode in the secondary anode compartment. In some embodiments the apparatus comprises one or more channels for collecting and removing bubbles from the secondary anode compartment. The apparatus may be configured to dynamically control the secondary anode during electroplating.

In some embodiments the apparatus is designed such that the primary anode has a diameter or width that is smaller than a diameter or width of a plating face of the substrate. In this design a portion of the plating chamber housing the primary anode may have a diameter or width that is smaller than a diameter or width of a plating face of the substrate.

In some embodiments of the apparatus the ionically resistive ionically permeable element comprises at least three portions: (a) an outer, ionically permeable portion; (b) a middle, ionically impermeable portion; and (c) an inner, ionically permeable portion, wherein the apparatus is configured to donate plating current from the secondary anode through the outer, ionically permeable portion, but not through the inner ionically permeable portion. In some embodiments the middle, ionically impermeable portion of the ionically resistive ionically permeable element is formed such that it is smaller on a surface of the ionically resistive ionically permeable element that is closest to the substrate than on the opposite surface of the element. In some embodiments, the middle, ionically impermeable portion of the ionically resistive ionically permeable element is formed between channels of the inner portion and of the outer portion, such that the channel openings on a surface of the ionically resistive ionically permeable element facing the substrate are distributed substantially uniformly along a radius of the ionically resistive ionically permeable element, and such that the channel openings on a surface of the ionically resistive ionically permeable element opposing the substrate are distributed such that there is an ionically impermeable portion that is greater than the average closest distance between channel openings in the outer and central portions, wherein this ionically impermeable portion corresponds to the middle ionically impermeable portion of the ionically resistive ionically permeable element.

During deposition, the ionically resistive ionically permeable element is preferably positioned in close proximity of the substrate and is typically separated from a plating surface of the substrate by a gap of 10 mm or less, with smaller gaps (e.g. 5 mm or less) being preferred in apparatuses processing smaller substrates (e.g. 300 mm diameter wafers) and larger gaps being useful in apparatuses configured for processing larger substrates (e.g. wafers with a 450 mm diameter or greater). Typically the dimensionless ratio of the substrate diameter to the size of the gap between the plateable surface of the substrate and the closest surface of the ionically resistive ionically permeable element should be greater than about 30:1. In some embodiments the apparatus further includes an inlet to the gap for introducing electrolyte flowing to the gap and an outlet to the gap for receiving electrolyte flowing through the gap, wherein the inlet and the outlet are positioned proximate azimuthally opposing perimeter locations of a plating face of the substrate, and wherein the inlet and outlet are adapted to generate cross-flow of electrolyte in the gap In some embodiments (e.g., when the secondary electrode is an azimuthally asymmetric electrode or a segmented electrode configured to correct azimuthal non-uniformity) the apparatus may further include a tertiary electrode configured for additionally controlling azimuthal uniformity, wherein the tertiary electrode is selected from the group consisting of an anode, a cathode and an anode-cathode, and wherein the tertiary electrode is an azimuthally asymmetric or multi-segmented electrode configured to donate and/or divert plating current to a first (azimuthal) portion of the substrate at a selected azimuthal position of the substrate differently than to a second portion of the substrate having the same average arc length and the same average radial position and residing at a different azimuthal angular position. The tertiary electrode in some embodiments is configured to donate and/or divert plating current to the substrate and/or from the substrate through the ionically resistive ionically permeable element, wherein the tertiary electrode is positioned such that the donated and/or diverted plating current does not cross the ion-permeable membrane separating the anolyte and catholyte compartment. In some embodiments, the secondary and the tertiary electrode is each separately powered and operated such that they donate (or divert) plating current to two different azimuthal regions of the substrate, by donating (or diverting) current to two different azimuthal regions below the ionically resistive ionically permeable element but above the membrane that separates the anolyte and catholyte. The combination of the secondary and teriary electrodes may in some embodiments result in a configuration where current is modified substantially over 360 degrees of the periphery of the substrate, where the secondary and tertiary electrode each controls its azimuthal segment, resulting in an overall correction over the entirety of azimuthal positions. In other embodiments, the combination of secondary and tertiary electrodes controls an azimuthally asymmetric segment. For example a secondary electrode may control plating current over 180 degrees, and the tertiary electrode may control plating current for non-overlapping 50 degrees (referring to azimuthal position).

In some embodiments the secondary electrode is a cathode that is configured to be negatively biased relative to the anode and wafer during electroplating and is configured to divert current from the substrate.

In some embodiments the secondary electrode is an anode-cathode that is configured to be either negatively and positively biased during electroplating. In some embodiments, during electroplating of a single substrate, the secondary electrode serves as a secondary anode for a portion of the plating time and as a secondary cathode for another portion of plating time. In other embodiments, the secondary anode-cathode, may serve as an anode during plating on a first substrate, and as a cathode during plating on a second, dissimilar substrate.

The secondary electrode (anode, cathode or an anode/cathode) in some embodiments is generally azimuthally symmetrical and is configured to donate and/or divert substantially the same amount of plating current to all portions of the substrate having the same radial position, irrespective of azimuthal position. In other embodiments the secondary electrode (anode, cathode or anode-cathode) is configured to donate and/or divert different amounts of plating current to a first portion of the substrate at a selected azimuthal position of the substrate differently than to a second portion of the substrate having the same average arc length and the same average radial position and residing at a different azimuthal angular position. In some embodiments such secondary anode, cathode or anode-cathode is azimuthally asymmetric (e.g. C-shaped). In some embodiments such secondary electrode is segmented, and segments can be separately controlled and energized in a coordination fashion with substrate rotation, angular positon, and time.

In some embodiments the apparatus includes one or more azimuthally asymmetric shields configured to block plating current. In some embodiments the apparatus is configured to rotate at a different speed, when a selected azimuthal position of the wafer passes over the azimuthally asymmetric shield, thereby resulting in an azimuthal correction of non-uniformity. In some embodiments (instead of or in addition to the use of azimuthally asymmetric shields), the ionically resistive ionically permeable element is azimuthally asymmetric and comprises an azimuthally asymmetrically positioned portion that does not allow the plating current to pass through the ionically resistive ionically permeable element. For example, the generally circular element may include an azimuthally asymmetric portion with blocked channels or no channels.

In another aspect of the invention a method of electroplating a metal on a cathodically biased substrate is provided, wherein the method includes: (a) providing the substrate into an electroplating apparatus configured for rotating the substrate during electroplating, wherein the apparatus comprises: (i) a plating chamber configured to contain an electrolyte, the plating chamber comprising a catholyte compartment and an anolyte compartment, wherein the anolyte compartment and the catholyte compartment are separated by an ion-permeable membrane; (ii) a substrate holder configured to hold and rotate the substrate in the catholyte compartment during electroplating; (iii) a primary anode positioned in the anolyte compartment of the plating chamber; (iv) an ionically resistive ionically permeable element positioned between the ion-permeable membrane and the substrate holder, wherein the ionically resistive ionically permeable element is adapted to provide ionic transport through the element during electroplating; and (v) a secondary electrode configured to donate and/or divert plating current to the substrate and/or from the substrate, wherein the secondary electrode is positioned such that the donated and/or diverted plating current does not cross the ion-permeable membrane separating the anolyte and catholyte compartments and wherein the secondary electrode is positioned such as to donate and/or divert plating current through the ionically resistive ionically permeable element; (b) electroplating the metal on the substrate while rotating the substrate, and while providing power to the secondary electrode and the primary anode. The method may further include: after electroplating metal on the substrate, electroplating metal on a second substrate that has a different distribution of recessed features in an outer portion of the second substrate than the first substrate, without substituting any mechanical shields in the apparatus. The power provided to the secondary electrode may be dynamically varied (e.g., increased, decreased or pulsed) during electroplating. The substrate is rotated during electroplating.

In another aspect of the invention, an electroplating apparatus for electroplating metal on a substrate is provided, wherein the apparatus includes (a) a plating chamber configured to contain an electrolyte, the plating chamber comprising a catholyte compartment and an anolyte compartment, wherein the anolyte compartment and the catholyte compartment are separated by an ion-permeable membrane; (b) a substrate holder configured to hold and rotate the substrate in the catholyte compartment during electroplating; (c) a primary anode positioned in the anolyte compartment of the plating chamber; (d) an ionically resistive ionically permeable element positioned between the ion-permeable membrane and the substrate holder, wherein the ionically resistive ionically permeable element is adapted to provide ionic transport through the element during electroplating; and (e) an azimuthally symmetric secondary anode configured to donate plating current to the substrate, wherein the secondary anode is positioned such that the donated plating current does not cross the ion-permeable membrane separating the anolyte and catholyte compartments, and wherein the secondary anode is positioned such as to donate plating current without passing it through the ionically resistive ionically permeable element.

In another aspect of the invention a method of electroplating a metal on a cathodically biased substrate is provided, wherein the method includes: (a) providing the substrate into an electroplating apparatus configured for rotating the substrate during electroplating, wherein the apparatus comprises: (i) a plating chamber configured to contain an electrolyte, the plating chamber comprising a catholyte compartment and an anolyte compartment, wherein the anolyte compartment and the catholyte compartment are separated by an ion-permeable membrane; (ii) a substrate holder configured to hold and rotate the substrate in the catholyte compartment during electroplating; (iii) a primary anode positioned in the anolyte compartment of the plating chamber; (iv) an ionically resistive ionically permeable element positioned between the ion-permeable membrane and the substrate holder, wherein the ionically resistive ionically permeable element is adapted to provide ionic transport through the element during electroplating; and (v) an azimuthally symmetric secondary anode configured to donate plating current to the substrate, wherein the secondary anode is positioned such that the donated plating current does not cross the ion-permeable membrane separating the anolyte and catholyte compartments, and wherein the secondary anode is positioned such as to donate plating current without passing it through the ionically resistive ionically permeable element; (b) electroplating the metal on the substrate while rotating the substrate, and while providing power to the secondary anode and the primary anode. The method may further include: after electroplating metal on the substrate, electroplating metal on a second substrate that has a different distribution of recessed features in an outer portion of the second substrate than the first substrate, without substituting any mechanical shields in the apparatus.

In some embodiments, any of the methods described herein are used in conjunction with photolithographic device processing. For example, the methods may further involve applying photoresist to the substrate; exposing the photoresist to light; patterning the photoresist and transferring the pattern to the substrate; and selectively removing the photoresist from the substrate. In some embodiments, a system is provided, wherein the system includes any of the apparatuses described herein and a stepper.

The apparatuses described herein further typically include a controller comprising program instructions or built-in logic for performing any of the electroplating methods described herein.

In another aspect, a non-transitory computer machine-readable medium is provided to control the apparatus provided herein. The machine-readable medium comprises code to perform any of the methods described herein, such as the method comprising: (a) electroplating metal on a substrate while providing power to a primary anode; and (b) electroplating metal on a second, dissimilar substrate in the same apparatus without changing mechanical shields in the apparatus, wherein at least one of (a) and (b) comprises providing power to the secondary electrode to control plating uniformity.

In yet another aspect of the invention the system and apparatus functions are generally reversed, namely the wafer substrate is operated as an anode and is positively biased while electroetching or electropolishing operations are performed on the substrate. The counter electrode in this apparatus operates as a cathode and is negatively biased and may be a either an active or inert (e.g. gas dissolving) cathode. The secondary or tertiary electrodes positioned as described above can function as either an anode, cathode, or both an anode and a cathode during the course of wafer processing. Electrolytes suitable for electropolishing or etching are held and circulated in the plating cell and counter electrode chambers and are generally viscous, low water content solutions and may include solvents that form complexes with or dissolve anodically formed metal ions in the solution. Examples of suitable electrolytes for electroetching and electropolishing include but are not limited to concentrated phosphoric acid, concentrated hydroxyethylidene-diphosphonic acid, concentrated sulfuric acid, and combinations of these.

These and other features and advantages of the present invention will be described in more detail below with reference to the associated drawings.

DETAILED DESCRIPTION

Figure 1A:
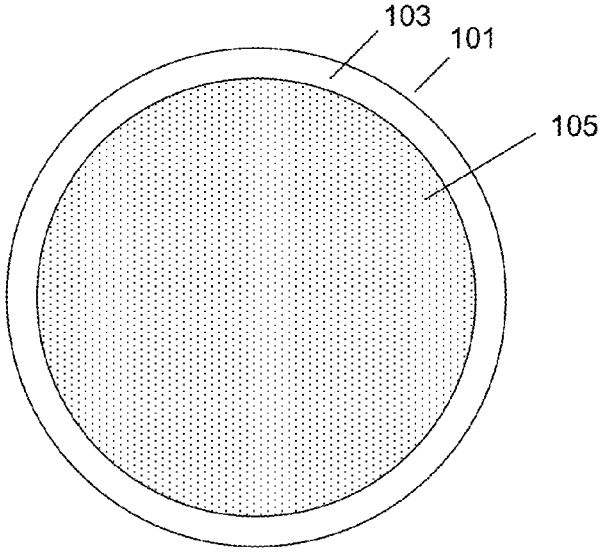
FIGS. 1A-1B show schematic top views of two dissimilar wafer substrates that can be processed in an apparatus provided herein.

Methods and apparatus for electroplating a metal on a substrate while controlling uniformity of the electroplated layer, such as radial uniformity, azimuthal uniformity, or both, are provided. The methods are particularly useful for sequentially electroplating metal on dissimilar substrates, such as on semiconductor wafers having different patterns or distribution of recessed features on the surface. The methods control plating current (ionic current) at the substrate using a remotely positioned secondary electrode.

Embodiments are described generally where the substrate is a semiconductor wafer; however the invention is not so limited. Provided apparatus and methods are useful for electroplating metals in TSV and WLP applications, but can also be used in a variety of other electroplating processes, including deposition of copper in damascene features. Examples of metals that can be electroplated using provided methods include, without limitation, copper, silver, tin, indium, chromium, a tin-lead composition, a tin-silver composition, nickel, cobalt, nickel and/or cobalt alloys with each other and with tungsten, a tin-copper composition, a tin-silver-copper composition, gold, palladium, and various alloys which include these metals and compositions.

In a typical electroplating process, the semiconductor wafer substrate, which may have one or more recessed features on its surface is placed into the wafer holder, and its platable (working) surface is immersed into an electrolyte contained in the electroplating bath. The wafer substrate is biased negatively, such that it serves as a cathode during electroplating. The ions of the platable metal (such as ions of metals listed above) which are contained in the electrolyte are being reduced at the surface of the negatively biased substrate during electroplating, thereby forming a layer of plated metal. The wafer, which is typically rotated during electroplating, experiences an electric field (ionic current field of the electrolyte) that may be non-uniform for a variety of reasons. This may lead to non-uniform deposition of metal. One of the types of non-uniformity is center-to-edge (or radial) non-uniformity, which manifests itself in different thicknesses of plating at different radial positions on the wafer at the same azimuthal (angular) position. Radial non-uniformity may arise from the terminal effect, due to greater amount of metal being deposited in the vicinity of electrical contacts on the wafer substrate. Because electrical contacts are made at the periphery of the wafer, around the edge of the wafer, the resistance to the flow of current in the metal seed layer, referred to as the "terminal effect", manifests itself in thicker plating at the edge of the wafer substrate in comparison to the center of the substrate. One of the methods that can diminish the radial non-uniformity due to terminal effect is the use of an ionically resistive ionically permeable element positioned in close proximity of the substrate, wherein the element has an ionically permeable (e.g., porous) region that terminates at a particular radial location from the center of the element and an ionically impermeable region beyond the selected radial location. This results in inhibiting flow of ionic current through the element beyond that selected radius because the element is not permeable there. Another method, used alone or in combination, is the placement of an annular shield that blocks or diverts the plating current from the edge of the wafer substrate to a more central location.

Figure 1B:
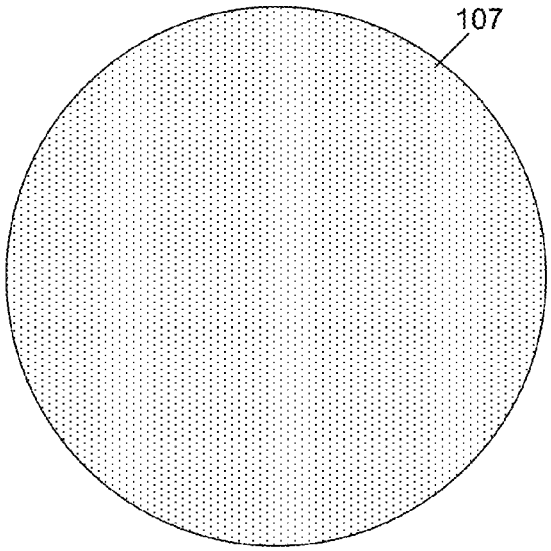

However, in many cases, dissimilar substrates, e.g., substrates that have a different distribution of recessed features on their surface will experience different distribution of plating current at their surface and may require different shields to reduce non-uniformity. Two semiconductor wafers having a different distribution of recessed features are schematically illustrated in FIGS. 1A and 1B. The wafer 101 shown in FIG. 1A has an outer region 103 that is not platable and is covered with photoresist, and a central region 105 that contains platable recessed features. A dissimilar wafer 107 is shown in FIG. 1B. This wafer has platable features substantially all over the wafer. When such dissimilar wafers are processed sequentially using one electroplating tool, a radial non-uniformity problem is encountered. If the tool uses an annular shield having an opening optimized for uniform plating of the wafer 107, the use of the same tool for electroplating on a wafer 101 will result in edge-thick plating about the perimeter of region 105, because of current crowding at this region due to the presence of unplatable outer region 103. In order to compensate for this effect, an annular shield having a smaller diameter of the opening should be used when processing the wafer 101. Thus, when wafers 101 and 107 are processed sequentially, the shields having different diameters of the central opening need to be sequentially used in order to achieve optimal non-uniformity in a conventional approach. For example, when a 300 mm wafer is used, a shield having a diameter of an inner opening of 11.45 inches (290.8 mm) may be used for processing a "full face exposed" wafer 107, while a shield having a diameter of an inner opening of 10.80 inches (274.3 mm) would be well suited for processing the wafer 101 that has a region of unpatterned photoresist at the edge. This change of shielding size and shielding element, however, is undesired and non-practical because change in the tool hardware requires significant operator intervention and associated unproductive tool downtime. Therefore there is a need for an apparatus that would be capable of processing dissimilar wafers without the necessity of manual intervention such as shield changes or other hardware modifications. More generally, dissimilar wafers that can be processed with apparatuses and methods provided herein include wafers having different diameters, different resistivities of seed layers, and different distributions of recessed features. In some embodiments, the differences between the wafers affect only radial uniformity. In other embodiments, the differences in the pattern layout between the wafers affect only azimuthal uniformity or a combination of azimuthal and radial uniformities.

An appropriately positioned second electrode that is configured to donate and/or divert plating current to and/or from the wafer substrate is used to modulate plating uniformity in the embodiments provided herein. The position of the electrode in relation to other components of the electroplating system is of high importance for a number of reasons including minimization of the manufacturing complexity and cost, improvement of reliability, and ease of assembly and maintainance. Two main configurations of an electroplating apparatus are shown. The configurations illustrate how the second electrode can be integrated into an electroplating system containing anolyte and catholyte compartments that are separated by a membrane. The configurations further show how a secondary electrode can be integrated with an ionically resistive ionically permeable element, such as a channeled ionically resistive plate (CIRP) positioned in the proximity of the substrate. Both configurations can be implemented in a Sabre 3D™ system available from Lam Research Corporation.

Anolyte and Catholyte Portions of a Plating Vessel

In both configurations of the apparatus provided herein the electroplating apparatus includes a plating chamber configured to hold electrolyte, where the plating chamber is separated by an ion-permeable membrane into anolyte and catholyte compartments. The primary anode is housed in the anolyte portion, while the substrate is immersed into the electrolyte in the catholyte portion across the membrane. The compositions of anolyte (electrolyte in the anolyte compartment) and catholyte (electrolyte in the catholyte compartment) can be the same or different.

The membrane allows ionic communication between the anolyte and catholyte regions of the plating cell, while preventing the particles generated at the primary anode from entering the proximity of the wafer and contaminating it. In some embodiments, the membrane is a nanoporous membrane (including but not limited to reverse osmosis membrane, a cationic or anionic membrane) that is capable of substantially preventing physical movement of the solvent and of dissolved components under the influence of pressure gradients, while allowing relatively free migration of one or more charged species contained in the electrolyte via ion migration (motion in response to the application of an electric field). Detailed descriptions of suitable anodic membranes are provided in U.S. Pat. Nos. 6,126,798 and 6,569,299 issued to Reid et al., both of which are incorporated herein by reference for all purposes. Ion exchange membranes, such as cationic exchange membranes are especially suitable for these applications. These membranes are typically made of ionomeric materials, such as perfluorinated co-polymers containing sulfonic groups (e.g. Nafion), sulfonated polyimides, and other materials known to those of skill in the art to be suitable for cation exchange. Selected examples of suitable Nafion membranes include N324 and N424 membranes available from Dupont de Nemours Co. The membrane separating catholyte and anolyte may have different selectivity for different cations. For example, it may allow passage of protons at a faster rate than the passage rate of metal ions (e.g. cupric ions).

Electroplating apparatus having membrane-separated catholyte and anolyte compartments achieves separation of catholyte and anolyte and allows them to have distinct compositions. For example, organic additives can be contained within catholyte, while the anolyte can remain essentially additive-free. Further, anolyte and catholyte may have differing concentrations of metal salt and acid, due, for example, to ionic selectivity of the membrane. An electroplating apparatus having a membrane is described in detail in U.S. Pat. No. 6,527,920 issued to Mayer et al., which is herein incorporated by reference for all purposes.

In both configurations of the electroplating apparatus provided herein, the secondary electrode is positioned such that the plating current donated and/or diverted by the secondary electrode is not passed through the membrane separating the anolyte and catholyte portions of the plating chamber.

Ionically Resistive Ionically Permeable Element

In both configurations of the apparatus provided herein, the apparatus includes an ionically resistive, ionically permeable element positioned in a close proximity of the substrate in the catholyte compartment of the plating chamber. This allows for free flow and transport of electrolyte through the element, but introduces a significant ionic resistance into the plating system, and may improve center-to-edge (radial) uniformity. In some embodiments, the ionically resistive ionically permeable element further serves as a source of electrolyte flow that exits the element in a direction that is substantially perpendicular to the working face of the substrate (impinging flow), and primarily functions as a flow-shaping element. In some embodiments the element includes channels or holes that are perpendicular to the platable surface of the wafer substrate. In some embodiments the element includes channels or holes that are at an angle that is different from 90 degrees relative to the platable surface of the wafer substrate. A typical ionically resistive ionically permeable element accounts for 80% or more of the entire voltage drop of the plating cell system. In contrast, the ionically resistive ionically permeable element has very little fluid flow resistance and contributes very little to the pressure drop of the cell and ancillary supporting plumbing network system. This is due to the large superficial surface area of the element (e.g., about 12 inches in diameter or 700 $cm^2$) and modest porosity and pore sizes (e.g. the element may have a porosity of about 1-5%) created by an appropriate number of drilled channels (also referred to as pores or holes) that may have a diameter of about 0.4 to 0.8 mm. For example, the calculated pressure drop for flowing 20 liters/minute through a porous plate having a porosity of 4.5% and thickness of 0.5 inches (e.g., a plate comprising 9600 drilled holes with 0.026" diameter) is less than 1 inch of water pressure (equal to approximately 0.036 psi). Suitable ionically resistive ionically permeable elements are described in detail, for example, in the U.S. Pat. No. 8,308,931, issued on Nov. 13, 2012, which is herein incorporated by reference in its entirety. Generally the ionically resistive ionically permeable element may include pores that form interconnecting channels within the body of the element but in many embodiments it is more preferable to use an element that has channels that do not interconnect within the body of the element (e.g., use a plate with non-interconnected drilled holes). The latter embodiment is referred to as channeled ionically resistive plate (CIRP). Two features of the CIRP are of particular importance: the placement of the CIRP in close proximity with respect to the substrate, and the fact that through-holes in the CIRP are spatially and ionically isolated from each other and do not form interconnecting channels within the body of the CIRP. Such through-holes will be referred to as 1-D through-holes because they extend in one dimension, often, but not necessarily, normal to the plated surface of the substrate (in some embodiments the 1-D holes are at an angle with respect to the wafer which is generally parallel to the CIRP front surface). These through-holes are distinct from 3-D porous networks, where the channels extend in three dimensions and form interconnecting pore structures. An example of a CIRP is a disc made of an ionically resistive material, such as polyethylene, polypropylene, polyvinylidene difluoride (PVDF), polytetrafluoroethylene, polysulphone, polyvinyl chloride (PVC), polycarbonate, and the like, having between about 6,000-12,000 1-D through-holes. The disc, in many embodiments, is substantially coextensive with the wafer (e.g., has a diameter of about 300 mm when used with a 300 mm wafer) and resides in close proximity of the wafer, e.g., just below the wafer in a wafer-facing-down electroplating apparatus. Preferably, the plated surface of the wafer resides within about 10 mm, more preferably within about 5 mm of the closest CIRP surface. In the second configuration of an apparatus that will be described herein the CIRP includes at least three segments: an inner segment configured to pass plating current from the primary anode, an outer segment configured to pass current from the secondary electrode, and a dead zone between the inner and outer segments that electrically isolates the inner and outer segments from each other and does not allow the plating currents from the primary anode and the secondary electrode to mix before they enter the CIRP or within the body of the CIRP.

The presence of a resistive but ionically permeable element close to the substrate substantially reduces the impact of and compensates for the terminal effect and improves radial plating uniformity. It also simultaneously provides the ability to have a substantially spatially-uniform impinging flow of electrolyte directed upwards at the wafer surface by acting as a flow diffusing manifold plate. Importantly, if the same element is placed farther from the wafer, the uniformity of ionic current and flow improvements become significantly less pronounced or non-existent. Further, because 1-D through-holes do not allow for lateral movement of ionic current or fluid motion within the CIRP, the center-to-edge current and flow movements are blocked within the CIRP, leading to further improvement in radial plating uniformity.

Another important feature of the CIRP structure is the diameter or principal dimension of the through-holes and its relation to the distance between the CIRP and the substrate. Preferably the diameter of each through-hole (or of majority of through-holes), should be no more than the distance from the plated substrate surface to the closest surface of the CIRP. Thus, the diameter or principal dimension of the through holes should not exceed 5 mm, when CIRP is placed within about 5 mm of the plated wafer surface.

In some embodiments the ionically resistive ionically permeable element (e.g., a CIRP) has a top surface that is parallel to the plated surface of the substrate. In other embodiments, the top surface of the ionically resistive ionically permeable element is concave or convex.

The apparatus is also configured such that the flow of the plating fluid backwards through the ionically resistive element is substantially prevented, even when the plating fluid is injected in a direction that is substantially parallel to the surface of the ionically resistive ionically permeable element. It is important to note that motion of incompressible fluids, such as water, involves various levels of scaling and balance of inertial and viscous forces. Considering the fluid dynamic Navier-Stokes equations and the fact that fluid flow behavior is governed by tensor (vector) equations with important inertial terms, one can understand that enabling the plating liquid to flow through the ionically resistive ionically permeable element from a manifold below and "upwards" through it may be facile (since low pressure is required to obtain a substantial amount of flow), but in contrast, fluid flowing parallel to the surface may have very little tendency and a "high resistance" to passing through the porous material at the same static pressure. Changing the direction of movement of fluid at a right angle from rapid movement parallel to the surface to movement that is normal to the surface involves the deceleration of the fluid and viscous dissipation of energy in the fluid, and therefore can be highly unfavorable. With that background, in other embodiments of this invention, the ionically resistive ionically permeable element has peripheral ancillary means (e.g. a fluid injector) for moving the fluid at a relatively high velocity in the direction parallel to the axis parallel to the wafer and CIRP surface, said CIRP element substantially preventing fluid from moving through the element and transiting to the exit side of elements' channels by passing into the element, through a manifold below the element and above the membrane, and then back through the element near the cross-flow exhaust side of the cell. In other words, the presence of the ionically resistive ionically permeable element combined with its pore size, porosity and parallel flow velocity, can prevent such a circumvention of the parallel flow from happening. Without wishing to be bound by any particular model or theory, it is believed that high velocity fluid has substantial amount of inertia in the direction of motion parallel to the ionically resistive element, would need to be decelerated and turn at right angle to enter the pores of the element, and as such, the ionically resistive element largely acts as a very good barrier preventing fluid from changing direction and passing through it. The two configurations of the electroplating apparatus provided herein differ in the position of the secondary electrode with respect to the ionically resistive ionically permeable element. In accordance with the first configuration provided herein, the second electrode is an azimuthally symmetrical anode (e.g., a ring) that is positioned such as to donate plating current to the substrate without passing the donated current through the ionically resistive ionically permeable element (e.g., a CIRP) and through the membrane separating the anolyte and catholyte compartments. This configuration is primarily used to control radial uniformity, but can additionally have the capability of azimuthal uniformity control, e.g., with the use of an additional azimuthally asymmetric or segmented tertiary electrode.

Example of a First Configuration of an Electroplating Apparatus

Figure 2A:
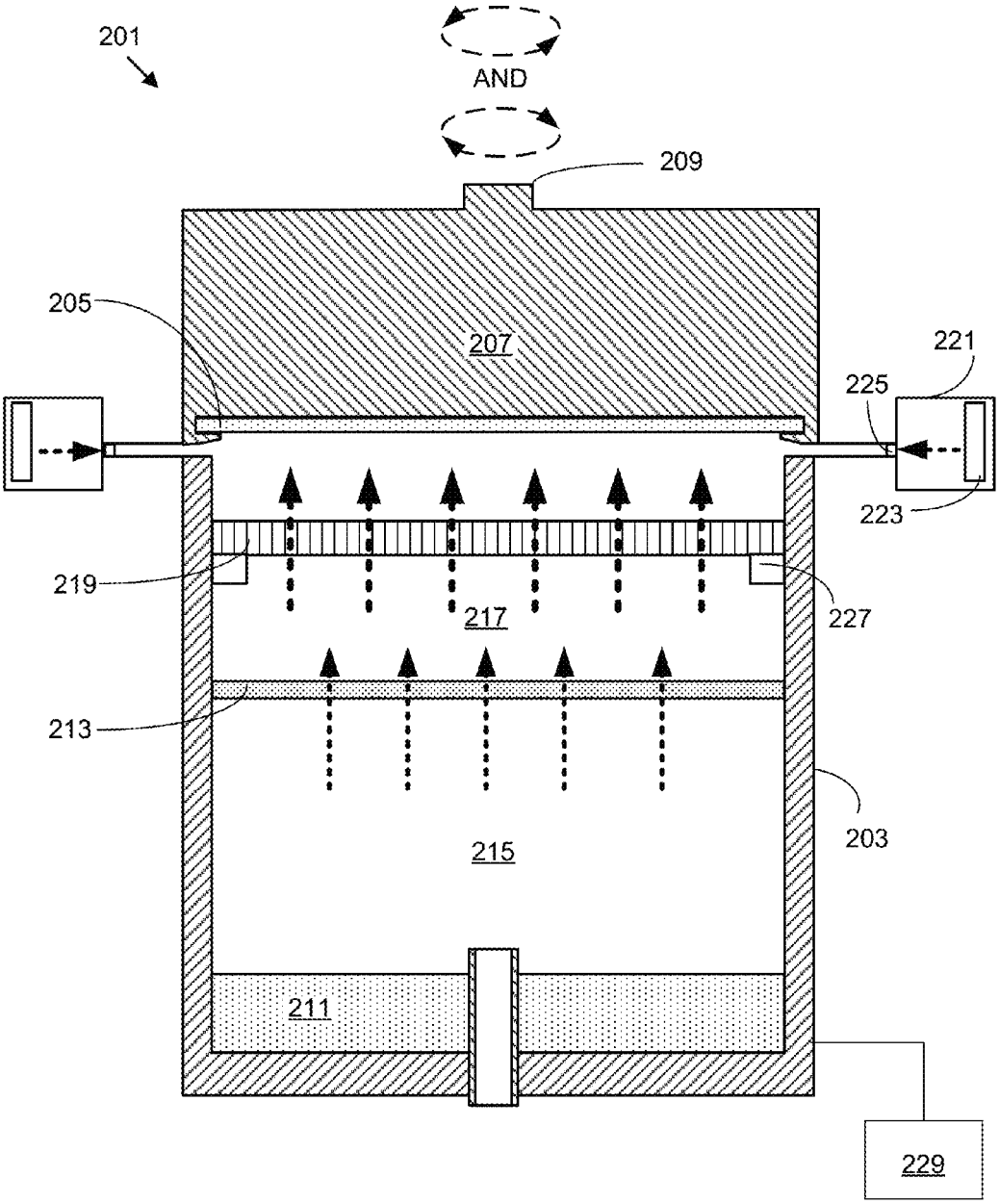
FIG. 2A is a schematic cross-sectional view of an electroplating apparatus in accordance with a first configuration provided herein.

An illustration of a plating system of a first configuration, which employs a resistive element in close proximity to the wafer, a membrane separating anolyte and catholyte compartments, and a secondary anode is shown in FIG. 2A. This is one example of a plating system, and it is understood that the plating system can be modified within the spirit and scope of appended claims. For example, an annular shield need not be present in all embodiments, and when present, the shield may be positioned below the CIRP, above the CIRP, or can be integrated with the CIRP.

Referring to FIG. 2A, a diagrammatical cross-sectional view of an electroplating apparatus 201 is shown. The plating vessel 203 contains the plating solution, which typically includes a source of metal ions and an acid. A wafer 205 is immersed into the plating solution and is held by a "clamshell" holding fixture 207, mounted on a rotatable spindle 209, which allows bidirectional rotation of clamshell 207 together with the wafer 205. A general description of a clamshell-type plating apparatus having aspects suitable for use with this invention is described in detail in U.S. Pat. No. 6,156,167 issued to Patton et al., and U.S. Pat. No. 6,800,187 issued to Reid et al, previously incorporated by reference. A primary anode 211 (which may be an inert or a consumable anode) is disposed below the wafer within the plating bath 203 and is separated from the wafer region by a membrane 213, preferably an ion selective membrane. The region 215 below the anodic membrane is often referred to as an "anode chamber" or "anolyte compartment" and electrolyte within this chamber as "anolyte". The region 217 above the membrane 213 is referred to as a "catholyte compartment". The ion-selective anode membrane 213 allows ionic communication between the anodic and cathodic regions of the plating cell, while preventing the particles generated at the anode from entering the proximity of the wafer and contaminating it and/or undesirable chemical species, present in the catholyte electrolyte, from coming into contact with the anode 211.

The plating solution is continuously provided to plating bath 203 by a pump (not shown). In some embodiments, the plating solution flows upwards through the membrane 213 and the CIRP 219 (or other ionically resistive ionically permeable element) located in close proximity of the wafer. In other embodiments, such as when the membrane 213 is largely impermeable to flow of the plating fluid (e.g. a nanoporous media such as a cationic membrane), the plating fluid enters the plating chamber between the membrane 213 and CIRP 219, for example at the chamber periphery, and then flows through the CIRP. In this case, plating fluid within the anode chamber may be circulated and the pressure can be regulated separately from the CIRP and cathode chamber. Such separate regulation is described, for example, in the U.S. Pat. No. 8,603,305, issued Dec. 10, 2013 and in the U.S. Pat. No. 6,527,920, issued Mar. 4, 2003, both of which are herein incorporated by reference in their entireties.

A secondary anode chamber 221, housing the secondary anode 223 is located on the outside of the plating vessel 203 and peripheral to the wafer. In certain embodiments, the secondary anode chamber 221 is separated from the plating bath 203 by a wall having multiple openings (a membrane support structure) covered by an ion-permeable membrane 225. The membrane allows ionic communication between the plating cell and the secondary anode chamber, thereby allowing the plating current to be donated by the second anode. The porosity of this membrane is such that it does not allow particulate material to cross from the secondary anode chamber 221 to the plating bath 203 and result in the wafer contamination. Other mechanisms for allowing fluidic and/or ionic communication between the secondary anode chamber and the main plating vessel are within the scope of this invention. Examples include designs in which the membrane, rather than an impermeable wall, provides most of the barrier between plating solution in the second cathode chamber and plating solution in the main plating vessel. A rigid framework may provide support for the membrane in such embodiments.

Additionally, one or more shields, such as an annular shield 227 can be positioned within the chamber. The shields are usually ring-shaped dielectric inserts, which are used for shaping the current profile and improving the uniformity of plating, such as those described in U.S. Pat. No. 6,027,631 issued to Broadbent, which is herein incorporated by reference in its entirety and for all purposes. Of course other shield designs and shapes may be employed as are known to those of skill in the art.

In general, the shields may take on any shape including that of wedges, bars, circles, ellipses and other geometric designs. The ring-shaped inserts may also have patterns at their inside diameter, which improve the ability of the shields to shape the current flux in the desired fashion. The function of the shields may differ, depending on their position in the plating cell. The apparatus of the present invention can include any of the static shields, as well as variable field shaping elements, such as those described in U.S. Pat. No. 6,402,923 issued to Mayer et al., or segmented anodes, such as described in a U.S. Pat. No. 6,497,801 issued to Woodruff et al, and U.S. Pat. No. 6,773,571 issued to Mayer et. al, each of which is herein incorporated by reference in its entirety.

Two DC power supplies (not shown) can be used to control current flow to the wafer 205, the primary anode 211 and to the secondary anode 223 respectively. Alternatively, one power supply with multiple independently controllable electrical outlets can be used to provide different levels of current to the wafer and to the secondary anode. The power supply or supplies are configured to negatively bias the wafer 205 and positively bias the primary anode 211 and secondary anode 223. The apparatus further includes a controller 229, which allows modulation of current and/or potential provided to the elements of electroplating cell. The controller may include program instructions specifying current and voltage levels that need to be applied to various elements of the plating cell, as well as times at which these levels need to be changed. For example, it may include program instructions for supplying power to the secondary anode, and, optionally for dynamically varying the power supplied to the secondary anode during electroplating.

Arrows show the plating current in the illustrated apparatus. Current originating from the primary anode is directed upward, passes through the membrane separating anolyte and catholyte compartments and the CIRP. Current originating from the secondary anode is directed from the periphery of the plating vessel to the center and does not pass through the membrane separating the anolyte and catholyte compartments and the CIRP.

The apparatus configuration described above is an illustration of one embodiment of the present invention. Those skilled in the art will appreciate that alternative plating cell configurations that include an appropriately positioned second cathode may be used. While shielding inserts are useful for improving plating uniformity, in some embodiments they may not be required, or alternative shielding configurations may be employed. In the described configuration the plating vessel and the primary anode are substantially coextensive with the wafer substrate. In other embodiments, the diameter of the plating vessel and/or of the primary anode may be smaller than the diameter of the wafer substrate, e.g., at least about 5% smaller.

Example of a Second Configuration of an Electroplating Apparatus

Figure 2B:
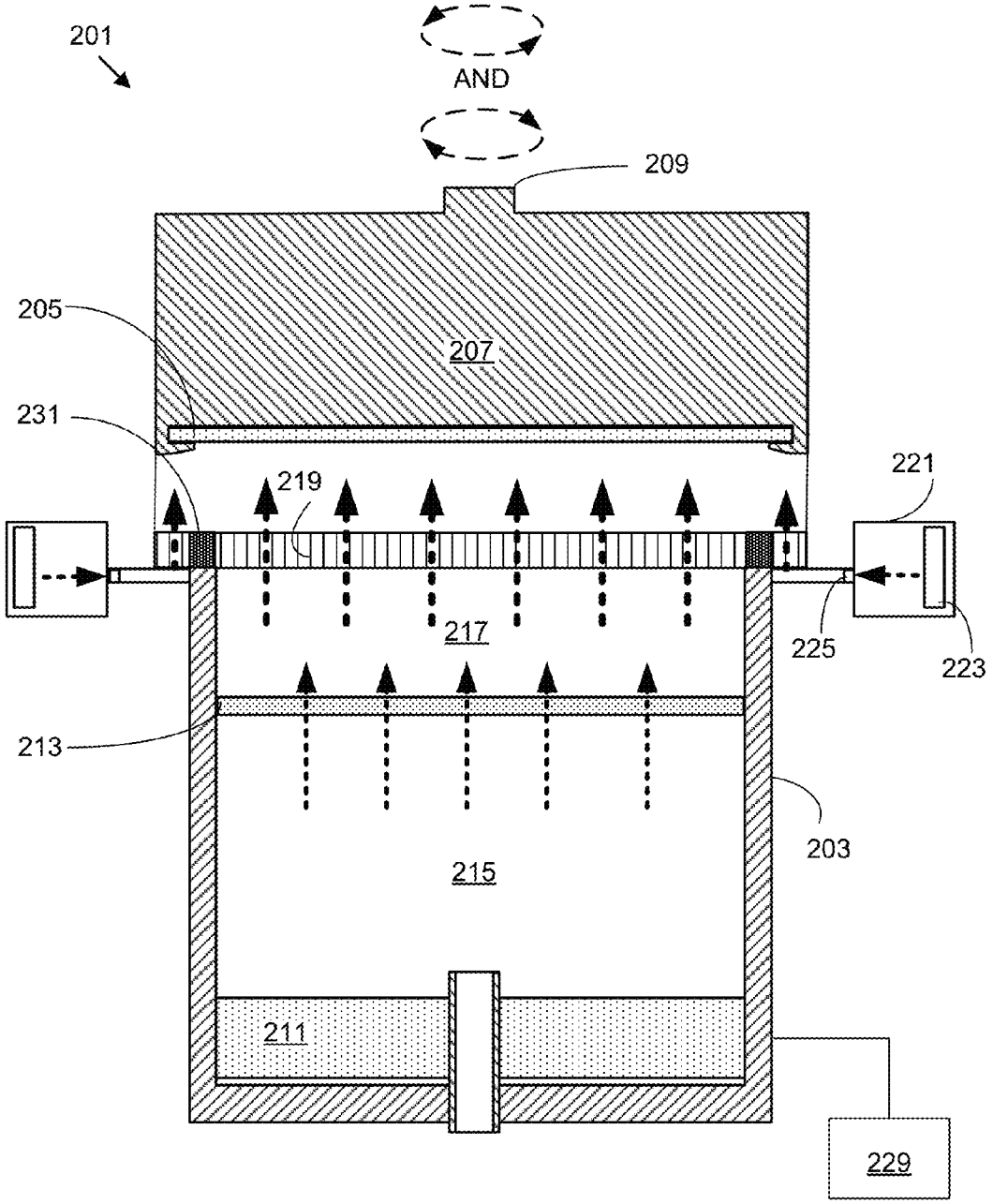
FIG. 2B is a schematic cross-sectional view of an electroplating apparatus in accordance with a second configuration provided herein.

In a second configuration of an apparatus provided herein, the secondary electrode (an anode, cathode, or an anode-cathode), which can be azimuthally symmetric or asymmetric is positioned, such that the current donated and/or diverted by such electrode does not pass through the membrane separating the anolyte and catholyte compartments, but passes through the ionically resistive ionically permeable element. A second configuration of the electroplating apparatus is illustrated in FIG. 2B. An apparatus having an azimuthally symmetrical ring-shaped secondary anode is shown in this specific example. More generally, other types of secondary electrodes positioned such that the current donated and/or diverted by the secondary electrode passes through the ionically resistive ionically permeable element are within the scope of this configuration. For example, the secondary electrode may be a symmetrical cathode, or a symmetrical anode-cathode configured to control radial uniformity. In some embodiments, the secondary electrode is an azimuthally asymmetrical anode, cathode or an anode-cathode, or a segmented anode, cathode or an anode-cathode configured to control azimuthal uniformity. Electrodes and methods for controlling azimuthal uniformity that can be used in this configuration are described in detail in the U.S. Pat. No. 8,858,774 by Mayer et al. titled "Electroplating Apparatus for Tailored Uniformity Profile" issued on Oct. 14, 2014, which is incorporated by reference in its entirety. These electrodes, when placed in a position, such as to pass their donated and/or diverted current through the ionically resistive ionically permeable element, can be effectively used to modulate azimuthal uniformity on the substrates.

Figure 3A:
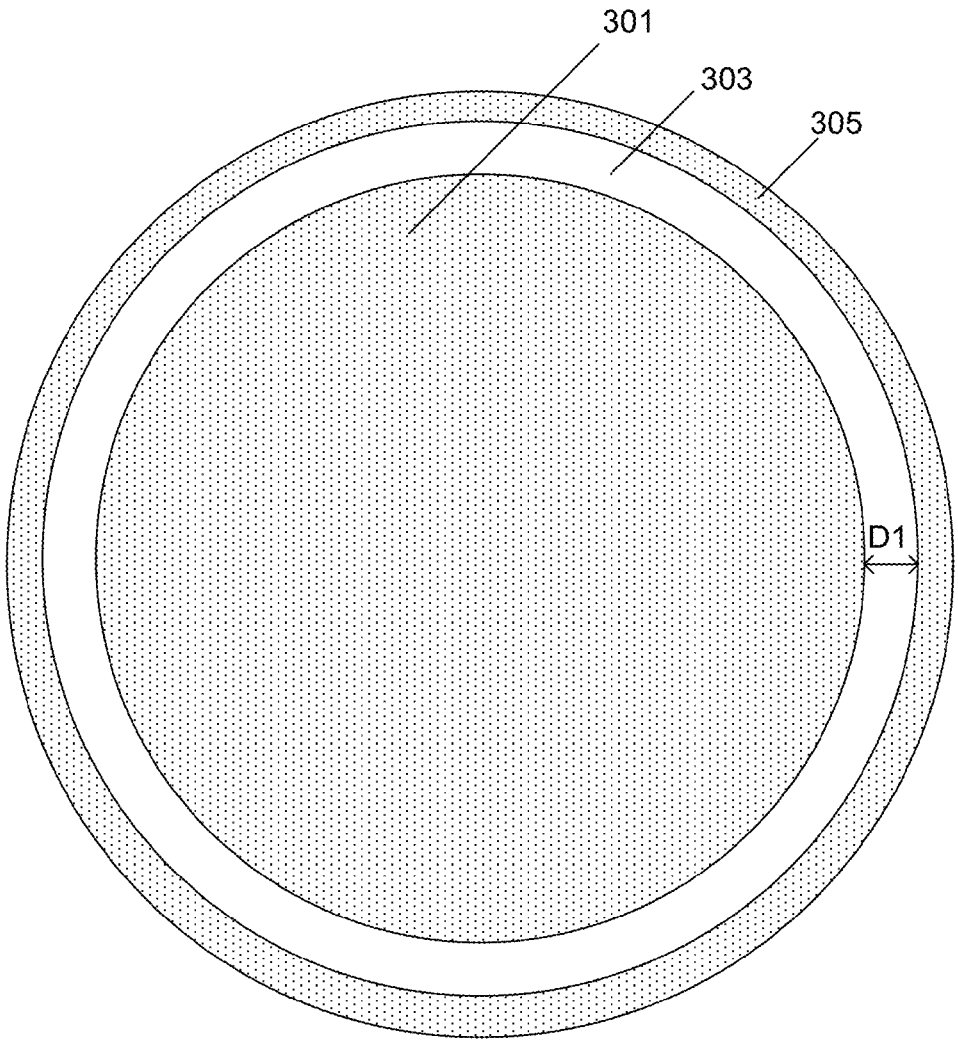
FIG. 3A shows a top view of a segmented ionically resistive ionically permeable element, in accordance with one embodiment provided herein.

Referring again to FIG. 2B, the second configuration of the apparatus is illustrated by an apparatus having an azimuthally symmetrical ring-shaped secondary anode. In the illustration shown in FIG. 2B, the secondary anode 223 is positioned in a secondary anode chamber 221 around the periphery of the plating vessel 203. The secondary anode chamber is in ionic communication with the catholyte portion of the plating vessel, such that the secondary anode donates plating current which passes laterally through the membrane 225 and then vertically towards the wafer through the CIRP 219. Positioning the secondary electrode, such that the current passes through the ionically resistive ionically permeable element was found to be associated with improved uniformity, particularly at the near-edge region of the wafer substrate. When the secondary electrode is positioned such that the current is passed through the ionically resistive ionically permeable element, the ionically resistive ionically permeable element is constructed such that it contains at least three distinct regions, where the region that passes current from the primary anode is electrically isolated from the region that passes current from the secondary electrode. The top view of such ionically resistive ionically permeable element, in accordance with some embodiments, is shown in FIG. 3A. The central portion 301 is typically substantially coextensive with the primary anode and is ionically permeable (e.g., contains non-communicating channels drilled through the plate); the "dead zone" portion 303 surrounds the central portion 301 and serves to prevent electrical and fluidic communication between the inner ionically permeable portion 301 and the outer ionically permeable portion 305. The "dead zone" portion, in some embodiments is ionically impermeable (i.e. it does not have any through-holes or the through-holes are blocked). In some embodiments the size of the "dead zone" is between about 1-4 mm. The outer portion 305 of the ionically resistive ionically permeable element is ionically permeable. The outer portion is connected via a fluidic conduit to the secondary electrode chamber on the side of the ionically resistive ionically permeable element that is opposite the side facing the wafer substrate. In this configuration, the currents from the primary anode and the secondary electrode do not mix below the ionically resistive ionically permeable element and within the body of the element due to the presence of the "dead zone" portion that electrically separates the currents. Another feature of the apparatus illustrated in FIG. 2B, is a reduced diameter of the plating vessel and of the primary anode. For example, in some embodiments, the diameter of the plating vessel and of the primary anode is about 1-10% smaller than the diameter of the wafer substrate. In some embodiments the primary anode is substantially coextensive with the inner portion of the segmented CIRP.

Figure 3B:
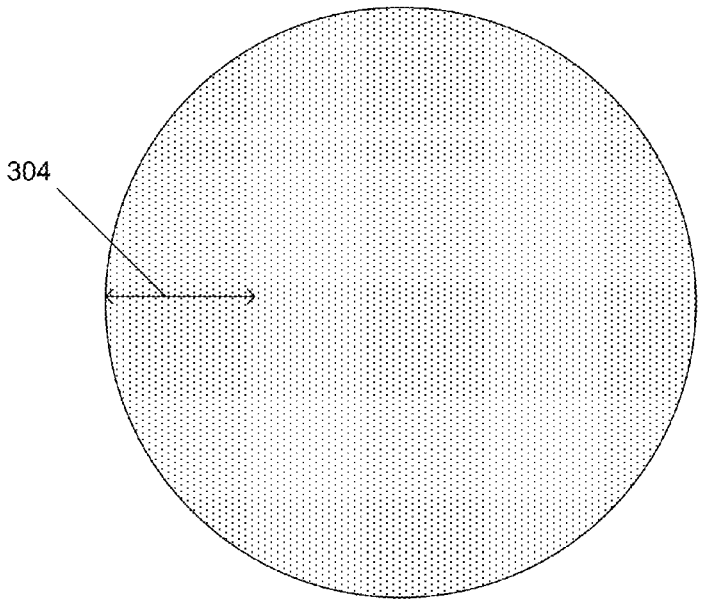
FIG. 3B shows a top view of a segmented ionically resistive ionically permeable element, in accordance with an embodiment provided herein.
Figure 3C:
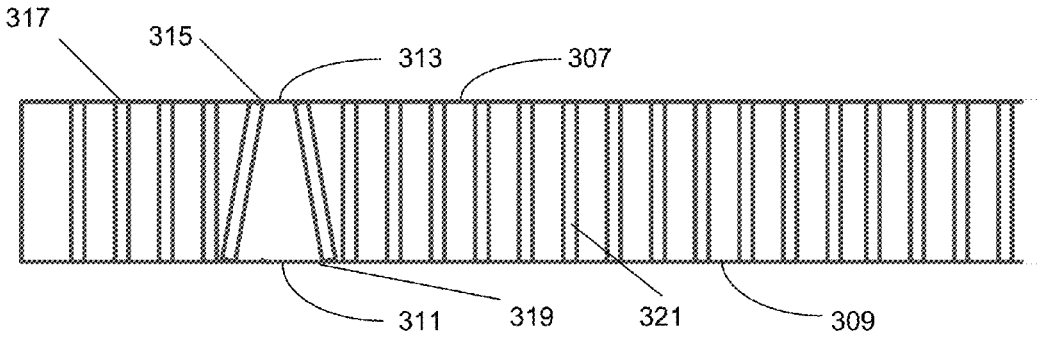
FIG. 3C is a cross-sectional view of a portion of the segmented ionically resistive ionically permeable element illustrated in FIG. 3B.

The presence of the dead zone is associated with the need to prevent mixing of currents from the primary anode and secondary electrode. Where the inner and outer portion meet, the ionically resistive ionically permeable element must make a seal with the boundaries of the anode chamber and of the secondary electrode chamber. This is illustrated by the dead zone 231 in FIG. 2B. While the prevention of electrical and fluidic communication between the inner and outer ionically permeable potions is necessary at the lower portion of the ionically resistive ionically permeable element, in the gap between the elements' upper surface and directly below the wafer, there is, by necessity, ionic and fluidic communication within the catholyte. The dead zone arises from the need to separate communication and seal the CIRP at its lower surface which is fartherst from the substrate. The impact of having a large dead zone (for example, when the dead zone is approximately the same size or lager than the CIRP to wafer distance) is that the current distribution on the wafer will be somewhat more non-uniform than desired since there would be less current in the region of the wafer directly above the dead zone due to a discontinuous radial source of ion flux emanating from the CIRP. To correct this deficiency, in some embodiments, a "dead zone" region of missing holes is made to exist only on the lower surface of the ionically permeable ionically resistive element (i.e. on the surface that is closest to the anode). This embodiment can be illustrated with reference to FIGS. 3A-3C. In this embodiment, the top surface of the CIRP (the surface closest to the substrate) and the bottom surface of the CIRP (the surface that is farther removed from the substrate and opposing the top surface) have different spatial distribution of channel openings, where the dead zone on the top surface is reduced in size or eliminated, whereas the dead zone at the bottom surface of the CIRP is present. With reference to this particular embodiment, FIG. 3A illustrates the view of the bottom surface of the CIRP, illustrating central region 301, the dead zone 303 and the outer region 305; FIG. 3B illustrates the top view of the same CIRP illustrating uniform distribution of channel openings on the top surface of the CIRP, and FIG. 3C illustrates a cross-sectional view of the CIRP region 304 which includes the outer portion of the CIRP, the dead zone, and part of the inner portion. As it can be seen, in this embodiment the dead zone at the bottom surface of the CIRP has a width D1, and is much smaller or is essentially absent from the top surface. For example, in some embodiments, the middle, ionically impermeable portion of the ionically resistive ionically permeable element is formed between channels of the central portion and of the outer portion, such that the channel openings on a surface of the ionically resistive ionically permeable element facing the substrate are distributed substantially uniformly along a radius of the ionically resistive ionically permeable element, and such that the channel openings on a surface of the ionically resistive ionically permeable element opposing the substrate are distributed such that there is an ionically impermeable portion that is greater than the average closest distance between channel openings in the outer and central portions, wherein the ionically impermeable portion corresponds to the middle ionically impermeable portion of the ionically resistive ionically permeable element.

This arrangement can be accomplished by having a set of channels that are directed at an angle radially inward (around the inner part of the outer portion of the CIRP) and channels directed at 90 degree angle (elsewhere on the outer portion of the CIRP), wherein the outer portion of the CIRP is ionically connected to the secondary electrode flow path. In addition, in some embodiments, there may be also a set of channels on the inner portion of the CIRP that are directed at an angle radially outward (around the outer part of the inner portion of the CIRP) and channels directed at 90 degrees (elsewhere on the inner portion of the CIRP), wherein the inner portion of the CIRP is ionically connected to primary anode flow path. In some cases the channel density on the upper surface can be uniform across the entire CIRP. Because the resistance of angled channels to current flow will be greater than resistance of normally directed channels, the diameter of the angled channels may be appropriately larger than the diameter of normally directed channels to compensate for the otherwise larger resistance due to longer channel length. Alternatively the net resistance of the holes can be made the same by having only a portion of the angled hole (e.g. at the lower, or at the upper CIRP surface) having a larger diameter (with the rest of the hole being the same diameter as the standard non-angled hole). The cross-sectional view shown in FIG. 3C illustrates an embodiment in which the outer and inner portions of the CIRP have angled channels at the interface with the dead zone. The portion of the CIRP includes a top surface 307 (that is closest to the substrate), and the opposing bottom surface 309. It can be seen that the dead zone 311 (the gap between the channel openings) on the bottom surface is substantially greater than the corresponding gap 313 on the top surface. In fact, this embodiment illustrates a substantially uniform distribution of channel openings on the top surface. The CIRP includes a plurality of channels 317 in the outer portion of the CIRP that are directed at 90 degrees towards the CIRP surfaces, and a plurality of channels 315 that are directed radially inward (such that the opening of the channel on the top surface is closer to the center of the CIRP than the opening of the same channel on the bottom surface) at the interface of the outer portion with the dead zone. Similarly, the inner portion of the CIRP includes a plurality of channels 321 that are directed at 90 degrees towards the CIRP surfaces, and a plurality of channels 319 that are directed radially outward (such that the opening of the channel on the top surface is farther from the center of the CIRP than the opening of the same channel on the bottom surface) at the interface of the inner portion with the dead zone. The outer portion of the CIRP is ionically connected to the second electrode, while the inner portion of the CIRP is ionically connected to the anode. It is noted that in some embodiments channels at the interface with the dead zone (middle ionically impermeable portion of the CIRP) are only directed inwards in the outer portion but the channels in the inner portion may remain normally (at a 90 degree angle) directed. In other embodiments channels at the interface with the dead zone (middle ionically impermeable portion of the CIRP) are only directed outward in the inner portion but the channels in the outer portion may all be normally directed.

Additional Features of Provided Apparatuses

Figure 3D:
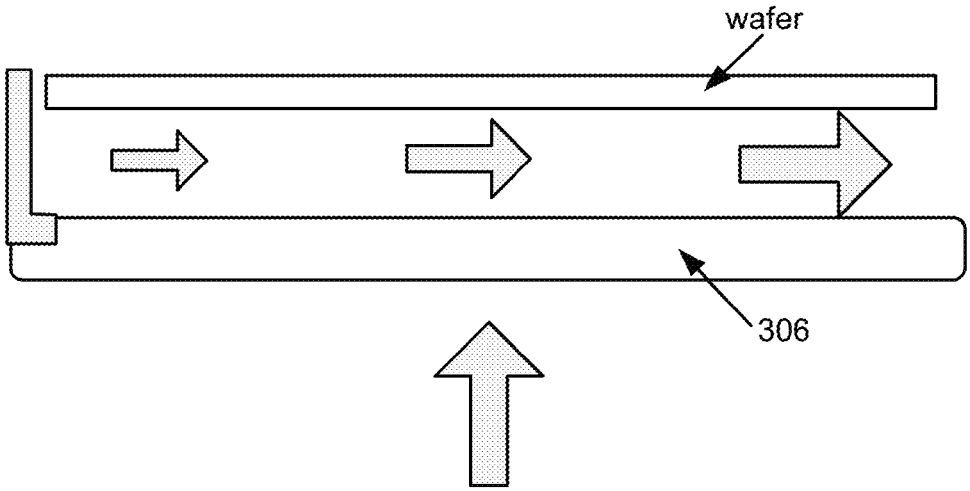
FIG. 3D shows a view of an assembly for providing a lateral flow of electrolyte at the surface of the wafer that can be used in apparatuses provided herein.
Figure 3E:
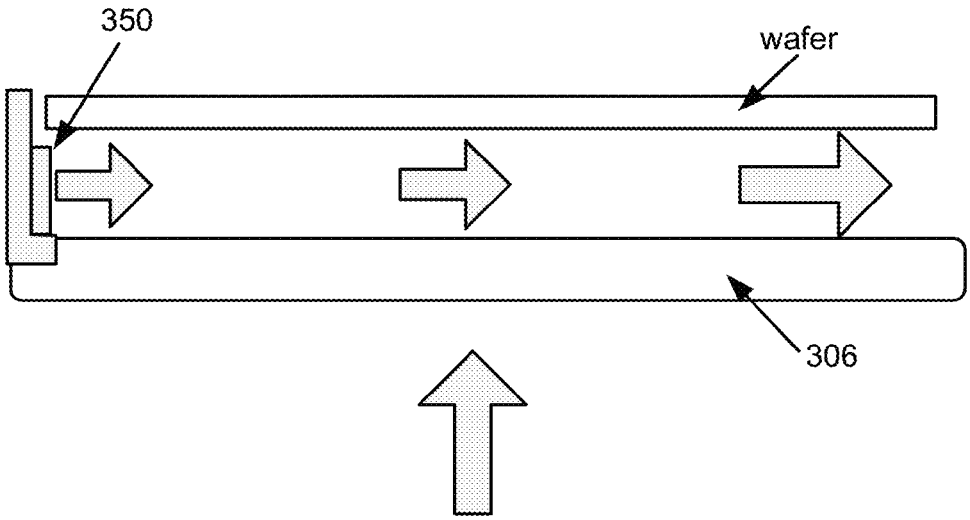
FIG. 3E shows a view of another embodiment of an assembly for providing a lateral flow of electrolyte at the surface of the wafer that can be used in apparatuses provided herein.

In some embodiments it is preferable to equip the apparatus having a first or second configuration with a manifold that provides for a cross-flow of electrolyte near the surface of the wafer. Such manifold is particularly advantageous for electroplating in relatively large recessed features, such as WLP or TSV features. In these embodiments the apparatus may include a flow shaping element positioned between the CIRP and the wafer, where the flow-shaping element provides for a cross-flow substantially parallel to the surface of the wafer substrate. For example the flow shaping element may be an omega-shaped plate that directs the cross-flow is directed towards an opening in the plate. A cross-sectional depiction of such configuration is illustrated in FIG. 3D, which shows that the electrolyte enters the CIRP 306 in a direction that is substantially perpendicular to the plating surface of the wafer, and that after exiting the CIRP a cross-flow in a direction that is substantially parallel to the plating surface of the wafer is induced, because the flow of electrolyte is restricted by a wall. A lateral flow of electrolyte through the center of the substrate in a direction that is substantially parallel to the surface of the substrate is achieved. In some embodiments, the cross-flow is further induced by injecting catholyte in a direction that is substantially parallel to the surface of the substrate at a desired angular position (e.g., substantially across from the opening). This embodiment is illustrated in FIG. 3E, which illustrates an injection manifold 350 which injects the catholyte laterally into the narrow gap between the CIRP and the substrate. Cross-flow manifolds and flow-shaping elements for providing cross-flow of electrolyte at the wafer surface that can be used in combination with the embodiments provided herein are described in detail in the U.S. Pat. No. 8,795,480 by Mayer et al., titled "Control of Electrolyte Hydrodynamics for Efficient Mass Transfer Control during Electroplating" issued on Aug. 5, 2014, and in US patent Publication No. 2013/0313123 by Abraham et al., titled "Cross Flow Manifold for Electroplating Apparatus", published on Nov. 28, 2013, which are herein incorporated by reference in their entireties.

Figure 4:
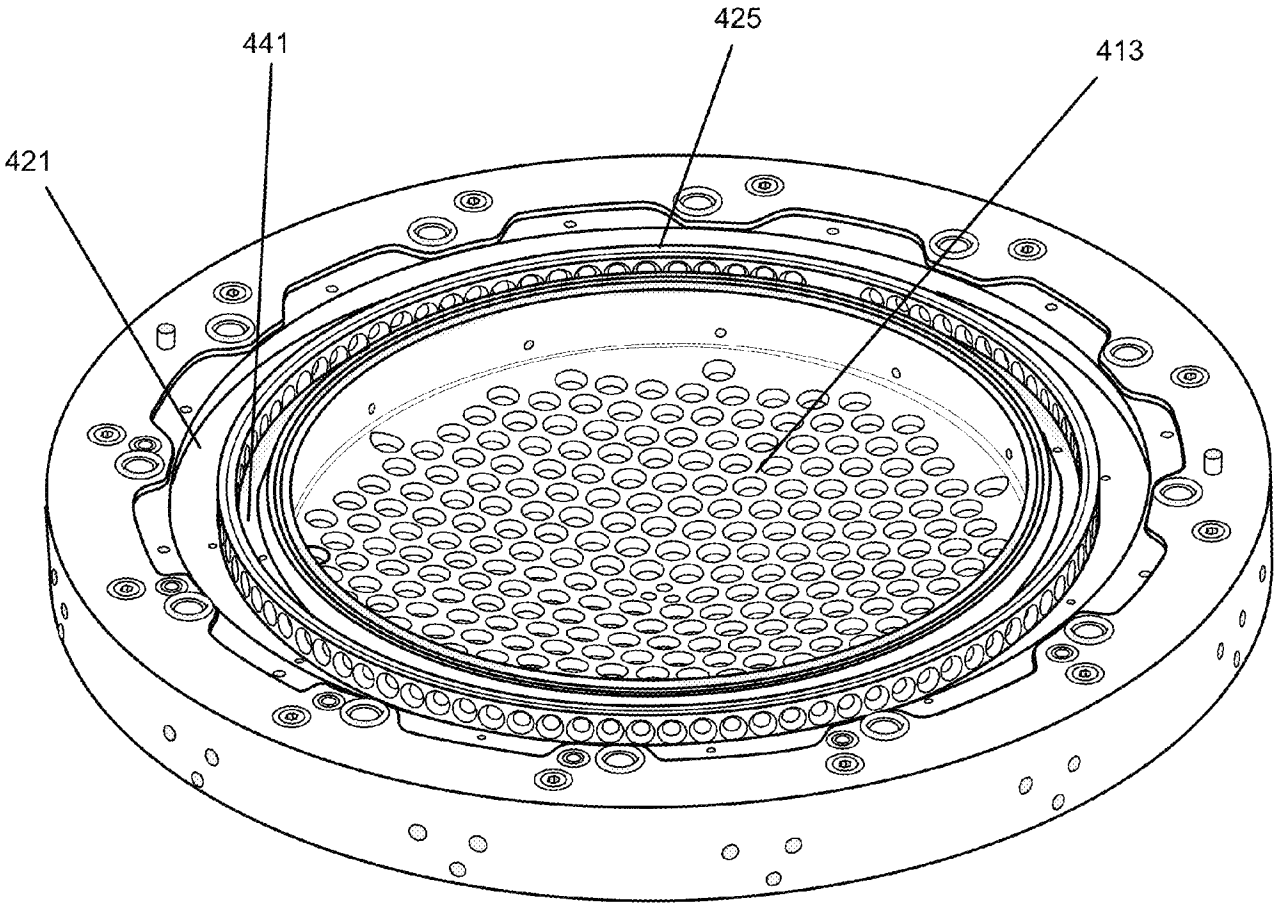
FIG. 4 is an isometric view of an assembly that includes a membrane separating anolyte and catholyte portions of the plating chamber and a membrane separating the secondary electrode chamber from the catholyte portion of the plating chamber.

In some embodiments, in the second configuration, the secondary electrode chamber is positioned around the periphery of the plating vessel just above the membrane separating the catholyte and anolyte compartments of the plating vessel. In some embodiments, the part of the apparatus holding this membrane and defining the walls of the secondary electrode chamber is one integral part. An example of this part is illustrated in FIG. 4, which shows a generally circular central support 413, onto which the membrane separating the catholyte and anolyte compartments is mounted. Around the periphery and above the circular central support 413, there are two generally annular cavities 421 and 441 separated by a generally annular membrane support 425. The outer cavity 421 is the second electrode chamber (the second electrode and the CIRP that should cover the depicted part from the top are not shown) which is separated by an ion-permeable membrane mounted to support 425 from the fluidic conduit 441. When the CIRP is placed over the depicted part, and because there are no CIRP holes in the area above the annular electrode residing within the secondary electrode chamber/cavity 421, the system is configured such that the plating current flows from the secondary electrode chamber 421 laterally through the membrane mounted to support 425 to the fluidic conduit 441 and then upward through the CIRP holes located at the same radius as fluid conduit 441. Depending on whether the second electrode acts as an anode or cathode, the current would flow into or out of the chamber to or from the wafer substrate.

Figure 5:
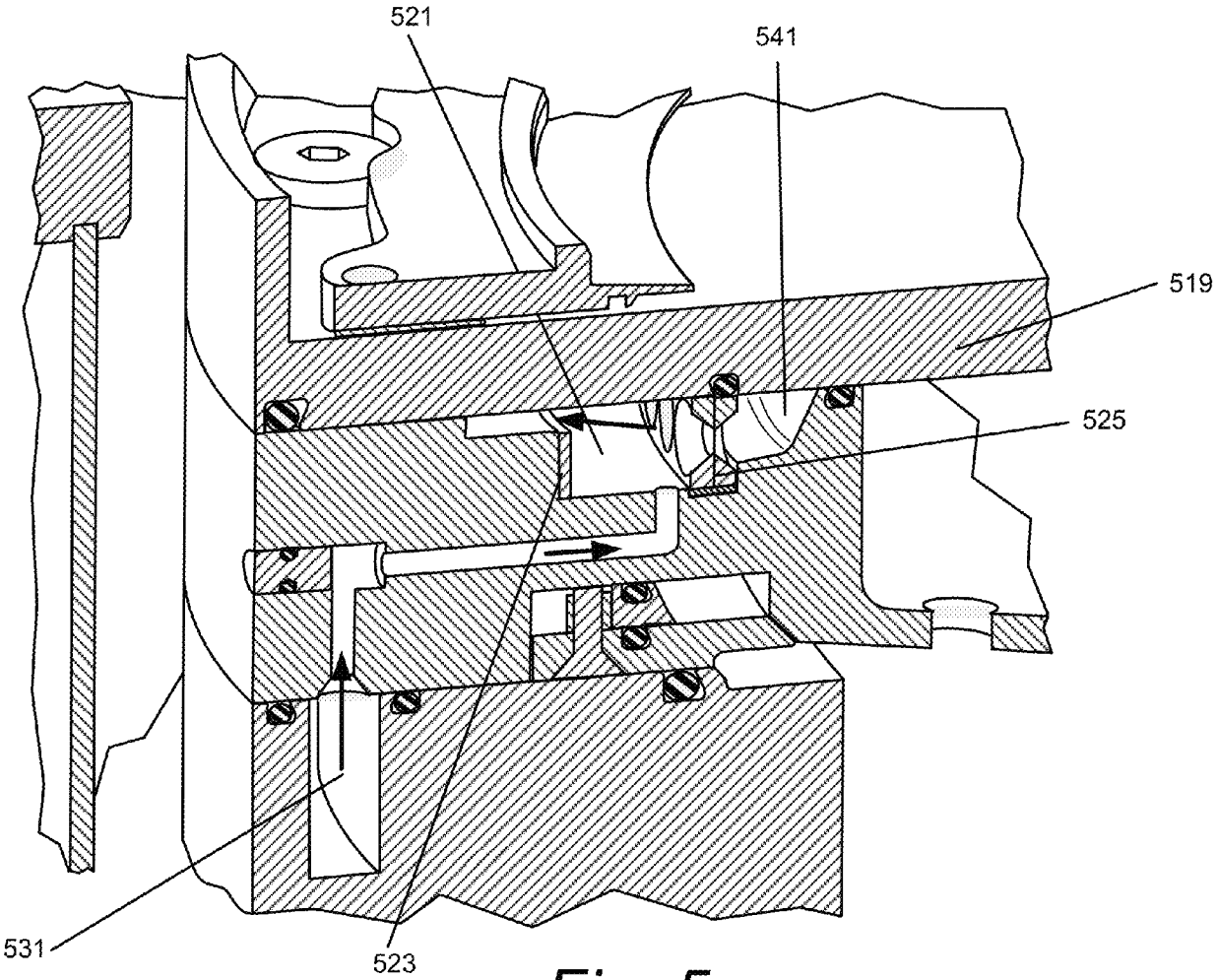
FIG. 5 provides a schematic cross-sectional view of the secondary electrode chamber in accordance with an embodiment provided herein.

In some embodiments, the second electrode chamber 521 and/or the fluidic chamber 541 (either in the first or second configuration) are irrigated through one or more dedicated irrigation channels configured to deliver suitable electrolyte to the respective chambers. The composition of the electrolyte may be the same or different as the composition of catholyte in the catholyte compartment of the electroplating chamber. FIG. 5 shows a cross-sectional depiction of a part of the apparatus of the second configuration, illustrating the irrigation channels. The secondary electrode 523 in these embodiments has an annular body positioned within the secondary electrode chamber 521. The secondary electrode chamber 521 is separated from a fluidic conduit 541 by an ionically permeable membrane mounted to membrane support 525. The CIRP plate is 519 is placed over the plating apparatus such that it covers both the secondary electrode chamber 521 and the fluidic conduit 541. However, in this configuration the outer portion of CIRP is blocked such that current cannot flow directly from the secondary electrode chamber 521 into the catholyte portion of the plating vessel, but can only do so after passing through the membrane through the fluidic conduit 541. The irrigating channel 531 delivers electrolyte to the secondary electrode chamber 521. The ions from the delivered electrolyte can then pass through the membrane mounted through support 525 through the fluidic conduit 541 and upwards through the CIRP 519 to the substrate, when the secondary electrode is an anode. In some embodiments the flow of irrigating electrolyte is directed over the secondary electrode such as to eject bubbles that may accumulate under the CIRP.

Figure 6:
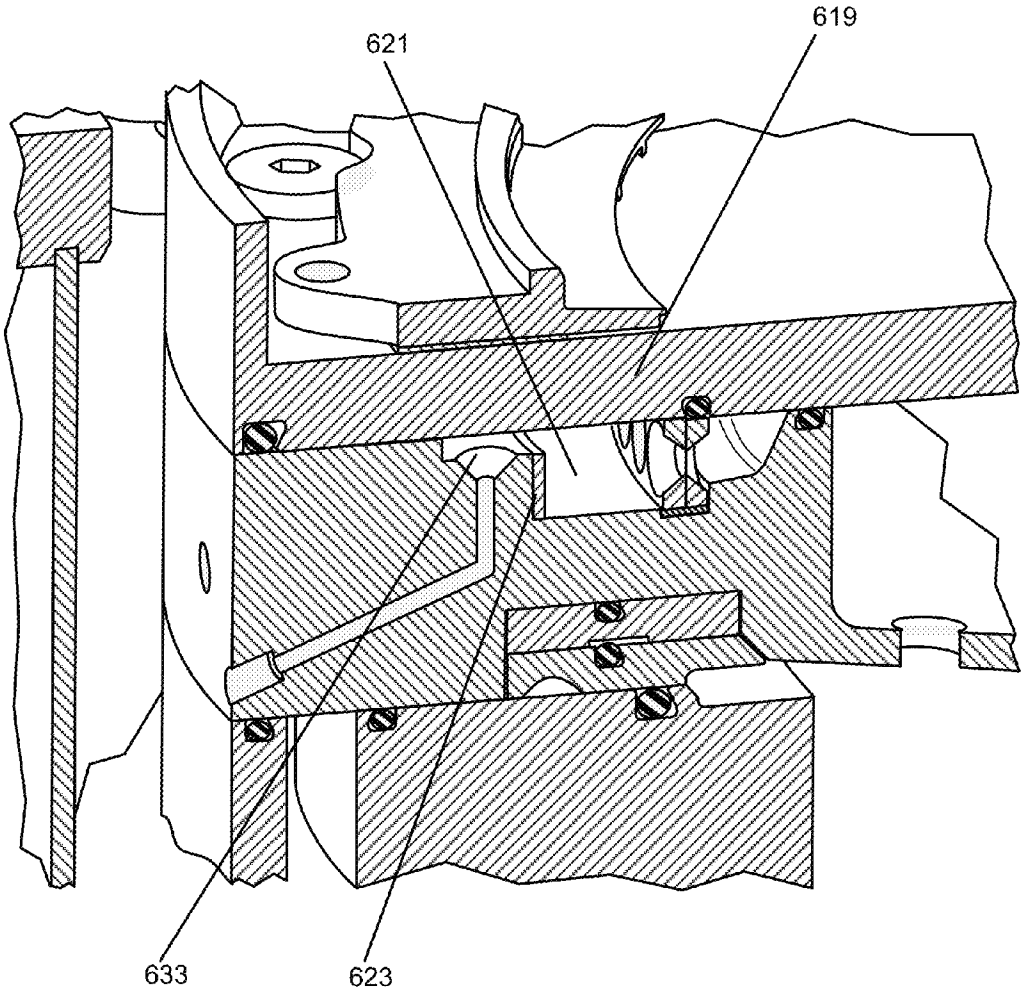
FIG. 6 provides a schematic cross-sectional view of the secondary electrode chamber illustrating a bubble removal mechanism in accordance with an embodiment provided herein.

In some embodiments the secondary electrode chamber includes a system for removing bubbles. Such system is particularly useful, when the secondary electrode is an inert secondary anode. A portion of an apparatus containing a system for removing bubbles is illustrated in the cross sectional depiction of FIG. 6. The elements are labeled similarly to the elements shown in FIG. 5. It is expected that during operation of the apparatus bubbles may accumulate just below the CIRP, and would be removed through the channel 633 connecting the top portion of the secondary electrode chamber 621 with a bubble-receiving end on the outside of the plating vessel.

In some embodiments (particularly when the secondary electrode is azimuthally asymmetric), a tertiary, separately controllable, electrode for additionally controlling azimuthal uniformity may be added. The tertiary electrode may be used in conjunction with both the first and second configurations of the apparatus. The tertiary electrode in the second configuration is preferably positioned such that the current diverted and/or donated by the tertiary electrode passes through the ionically resistive ionically permeable element but does not pass through the membrane separating anolyte and catholyte compartments. The suitable tertiary electrodes include azimuthally asymmetrical and segmented anodes, cathodes and anode-cathodes, such as those described in the U.S. Pat. No. 8,858,774 by Mayer et al. titled "Electroplating Apparatus for Tailored Uniformity Profile" issued on Oct. 14, 2014, previously incorporated by reference.

As it was mentioned above, both in the first and in the second configuration of the apparatus, the secondary electrode (e.g., an anode, a cathode, or an anode-cathode) may be separated from the substrate and catholyte compartment by an ion-permeable membrane. When an inert secondary anode is used, the membrane can prevent the transfer of bubbles from the secondary anode to the proximity of the substrate. For example, in the second configuration with an inert anode, the membrane prevents bubbles generated at the secondary inert anode from getting under the peripheral region of the CIRP, where the secondary current is confined. In other embodiments, the membrane is not used, and other methods of removing the bubbles are employed. For example, the apparatus may be configured to provide a strong flow of electrolyte in the direction opposing the bubble movement (e.g., in the direction towards the periphery of CIRP and away from the substrate). In other embodiments, instead of a membrane, the apparatus may include a directing member with a sloped surface in the proximity of the inert anode that would direct the bubbles away from the CIRP and/or the substrate. When an active (consumable) secondary anode is employed, the ionically permeable membrane between the active anode and the catholyte chamber is useful for preventing particles from being transferred from the secondary anode chamber to the catholyte chamber. In other embodiments, instead of a membrane, a high outward-directed flow of electrolyte may be used to prevent the particles from reaching the surface of the substrate. The electrolyte is returned to the plating bath after it passes through a pump and then through a filter that is configured to remove the particles.

Computational Modeling

Figure 7:
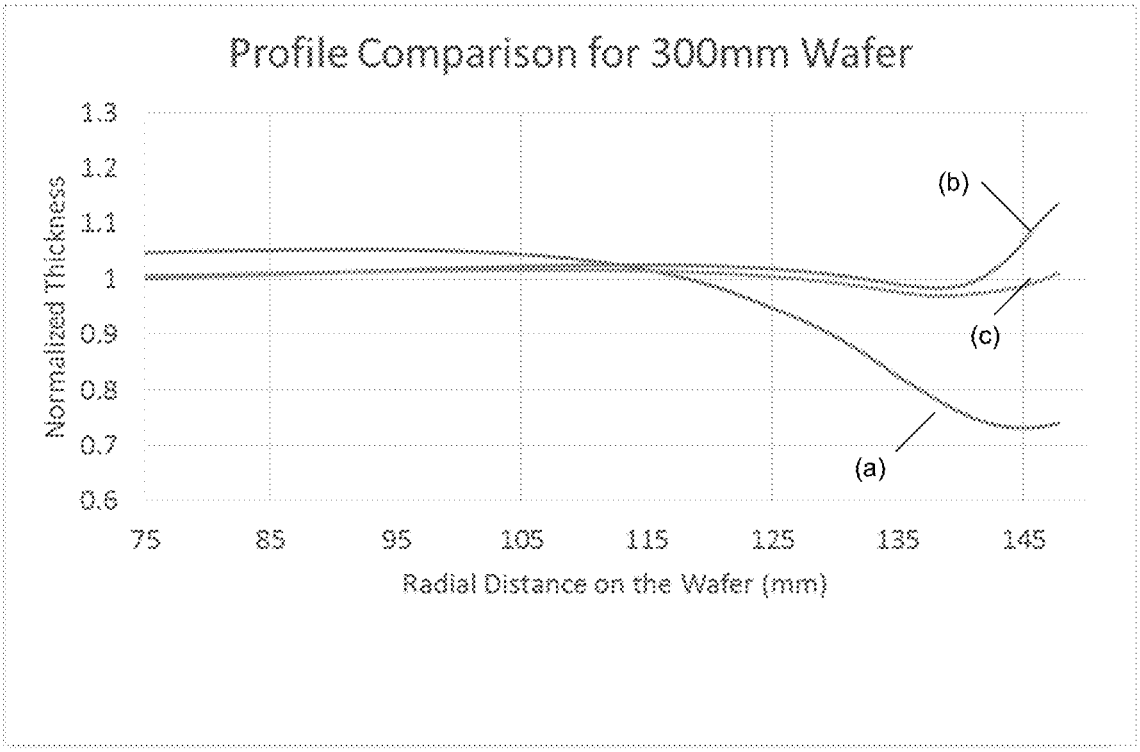
FIG. 7 shows a plot provided by computational modeling illustrating radial plating uniformity in systems with and without a secondary anode.

The improvement in radial non-uniformity of electroplating with the use of apparatuses provided herein was validated by computational modeling, and is illustrated in FIG. 7 which shows calculated radial thickness profiles for copper deposited in different electroplating apparatuses. In the computational models copper is electroplated on a wafer having a 300 mm diameter with an circular shield optimized for a wafer smaller than 300 mm in diameter. Modeling results are shown for a conventional apparatus (curve (a)), an apparatus having a first configuration (curve (b)), and an apparatus having a second configuration (curve (c)), wherein the apparatuses in all cases are equipped with a cross-flow manifold A conventional apparatus includes a plating chamber separated into catholyte and anolyte compartments by an ion-selective membrane, an anode positioned in the anolyte compartment, a CIRP positioned in the catholyte compartment and an annular shield positioned below the CIRP where the annular shield had a diameter of inner opening of 274 mm. The diameter of the anode and the diameter of CIRP are substantially the same as the diameter of the wafer substrate. No secondary anode is used in the model for the conventional apparatus. The thickness of plated copper along the radius of 300 mm wafer, according to the model is shown. It can be seen from curve (a) that in a conventional apparatus the thickness of plated copper at between about 115-150 mm of the wafer radius is substantially reduced due to overshielding.

An apparatus of the first configuration used in the computational model is identical to the conventional apparatus but includes a secondary anode in a secondary anode chamber that is remotely positioned around the periphery of the plating chamber and is fluidically connected with the catholyte compartment of the plating chamber such that the current donated by the second anode would not pass through the CIRP or the membrane separating the anolyte and catholyte portions of the plating chamber. The size of the primary anode, the CIRP, and the annular shield are the same as in the previous model for the conventional apparatus. During electroplating about 5-15% of the total power is applied to the secondary anode. It can be seen from curve (b) that thickness uniformity at radial positions of between about 115-140 mm is substantially improved in comparison with curve (a), and only at the near edge region (140-150 mm) the thickness of plating is increased in this model.

An apparatus of the second configuration used in this configuration is identical to the conventional apparatus but includes a secondary anode in a secondary anode chamber that is remotely positioned around the periphery of the plating chamber and is fluidically connected with the catholyte compartment of the plating chamber such that the current donated by the second anode would pass through an outer portion of CIRP. The current from the secondary anode would not pass through the membrane separating the anolyte and catholyte portions of the plating chamber. In this configuration the annular shield shielding the periphery of the substrate is not used in the model, but the plating chamber housing the anode is reduced in size to about 274 mm, which is similar to the size of the primary anode. The CIRP in this model contains three portions: the inner portion configured for passing current from the primary anode has a diameter of about 274 mm, the dead zone has a width of an annulus of about 2 mm, and the outer portion configured for passing current from the secondary anode has a width of an annulus of about 8 mm. During electroplating 5-15% of the total power as applied to the secondary anode. It can be seen from curve (c) that thickness uniformity is substantially improved both in comparison with curve (a) and curve (b).

Method

Figure 8:
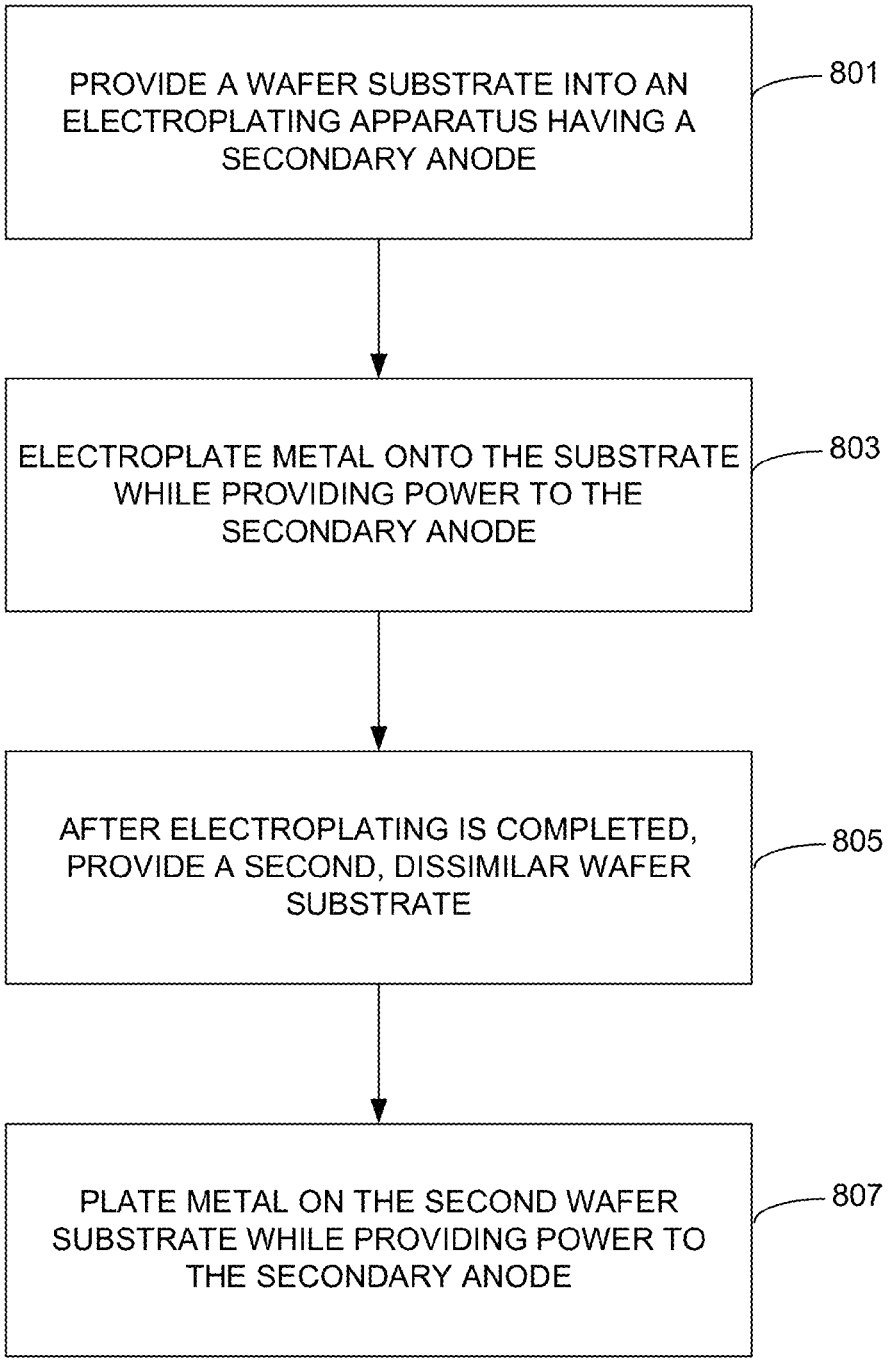
FIG. 8 is a process flow diagram for a process in accordance with one of the embodiments provided herein.

In one aspect of the invention, an electroplating method for plating metal on dissimilar substrates, such as on semiconductor wafers having different distribution of recessed features is provided. One of such methods is illustrated in the process flow diagram shown in FIG. 8. The process starts in 801 by providing a substrate into an apparatus having a secondary anode (e.g., an apparatus having a first or second configuration described herein). In operation 803 metal is electroplated on the substrate while providing power to the secondary anode. During electroplating the substrate is negatively biased and is rotated. In some embodiments the power provided to the secondary anode is dynamically varied during electroplating. After electroplating is completed, a second dissimilar wafer is provided in the apparatus in 805. Next, in operation 807 metal is plated on the second wafer while power is provided to the secondary anode. In some embodiments, the power provided to the secondary anode during electroplating on the second wafer is different than power provided to the first wafer and/or the power is dynamically modulated during electroplating differently than during plating on the first wafer substrate. In some embodiments, power is provided to the secondary anode only during electroplating of selected wafers. For example, during electroplating of a first wafer it may not be necessary to apply power to the secondary anode, while during electroplating on the second wafer, power to the secondary anode may be applied.

Dynamic control of power provided to the secondary anode can have a variety of forms. For example, power provided to the secondary anode may be gradually reduced or increased during electroplating. In other embodiments, power to the secondary anode may be turned off or turned on after a pre-determined time, e.g., corresponding to a predetermined thickness of electroplating. Finally, both the primary and secondary anode currents can change in a fixed ratio and in concert.

It is understood that the method is not limited to the use of secondary anodes and similarly can be employed with any secondary electrode as described herein. In some embodiments, the secondary electrode is azimuthally symmetric and electroplating results in a substantially azimuthally symmetric distribution of ionic current. In other embodiments, the secondary electrode is azimuthally asymmetric, or is segmented, and the method is configured to apply power to the secondary electrode (or different sections of segmented electrode) in coordination with substrate rotation, such that selected azimuthal positions on the substrate receive more or less ionic current, as desired.

In other embodiments, an azimuthally asymmetric secondary electrode (in a first or second apparatus configuration) can be used to provide a substantially azimuthally symmetric current modification, and is used mainly to modify radial plating uniformity. In these methods, the substrate is typically rotated at a very high rate (e.g., of at least 100 rotations per minute), while power is applied to an azimuthally asymmetric electrode (e.g., to a C-shaped anode). At a substantially constant high rotation rate, the substrate will in general experience primarily azimuthally symmetric correction of the plating current, even when an azimuthally asymmetric secondary electrode is used.

Azimuthal Uniformity

As it was previously mentioned, azimuthal uniformity can be modulated using an azimuthally asymmetric or segmented secondary electrode and by energizing the electrode or its individual segments in coordination with rotation of the wafer.

In some embodiments, azimuthal uniformity may be modulated by using azimuthally asymmetric shields or an azimuthally asymmetric CIRP with an ionically impermeable azimuthally asymmetric portion (e.g., a portion with no holes or blocked holes). In some implementations the rotation rate of the substrate is changed (e.g., the substrate rotates slower) when the selected azimuthal position on the wafer passes above the shield or above the ionically impermeable portion of the CIRP, thereby resulting in an increased dwell time for a selected azimuthal position in a shielded area. The use of azimuthally asymmetric shields and azimuthally asymmetric ionically resistive ionically permeable element is described in the U.S. Pat. No. 8,858,774 by Mayer et al. titled "Electroplating Apparatus for Tailored Uniformity Profile" issued on Oct. 14, 2014, previously incorporated by reference.

Figure 9:
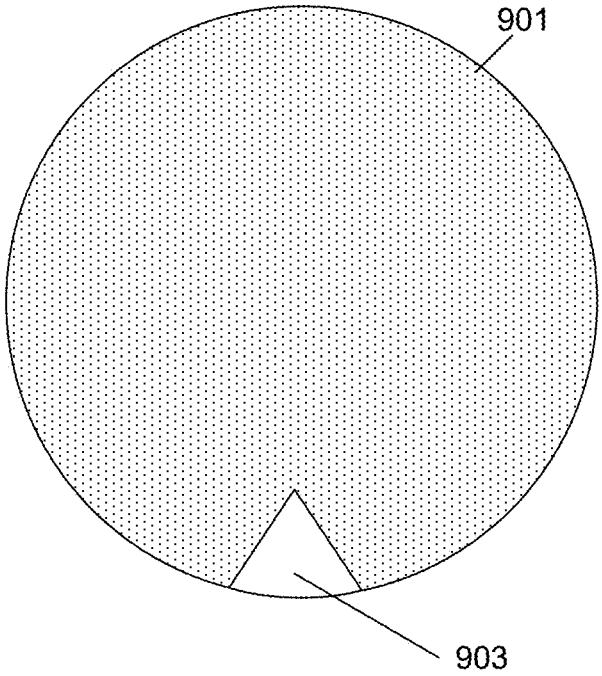
FIG. 9 is a top view of an azimuthally asymmetric ionically resistive ionically permeable element having an azimuthally asymmetrically positioned ionically impermeable portion, in accordance with some embodiments of the invention.

The top view of one example of an azimuthally asymmetric CIRP is shown in FIG. 9. The CIRP 901 has an azimuthally asymmetric portion 903, where the holes are blocked or absent. This embodiment can be used in both the first and second configurations of the apparatus presented herein. When used in the second configuration, the CIRP will also include an ionically impermeable dead zone that separates the ionic flows from the secondary electrode and the primary anode.

Controller

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the parameters of delivery of power to primary anode, secondary electrode, and the substrate. Specifically, the controller may provide instructions for timing of application of power, level of power applied, etc.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

Alternative Embodiments

While the use of secondary electrodes was illustrated with reference to electroplating apparatuses, in some embodiments the same concepts can be applied to electroetching and electropolishing apparatuses. In these apparatuses the polarities of the anode(s) and of the cathode(s) are reversed in comparison with an electroplating apparatus. For example, the primary anode of the electroplating apparatus serves as a primary cathode of an electroetching apparatus, while the substrate is positively biased, and serves as the main anode. In these embodiments, an apparatus for electrochemically removing metal from substrates is provided, where the apparatus can be used for processing dissimilar substrates without making changes to apparatus hardware to accommodate individual substrates with differences in radial distribution of features. The apparatus may rely, in some embodiments, on a combination of mechanical and electrochemical metal removal, and includes electroetching and electropolishing apparatuses.

In some embodiments an apparatus for electrochemically removing a metal on a substrate (e.g., an electroetching or electropolishing apparatus) is provided, wherein the apparatus includes: (a) a chamber configured to contain an electrolyte, the chamber comprising a catholyte compartment and an anolyte compartment (an anolyte compartment referring to the compartment housing the positively biased substrate, that serves as an anode), wherein the anolyte compartment and the catholyte compartment are separated by an ion-permeable membrane; (b) a substrate holder configured to hold the positively biased substrate in the anolyte compartment during electroplating; (c) a primary cathode positioned in the catholyte compartment of the plating chamber; (d) an ionically resistive ionically permeable element positioned between the ion-permeable membrane and the substrate holder, wherein the ionically resistive ionically permeable element is adapted to provide ionic transport through the element during electroplating; and (e) a secondary electrode configured to donate and/or divert plating current to and/or from the substrate, wherein the secondary electrode is positioned such that the donated and/or diverted plating current does not cross the ion-permeable membrane separating the anolyte and catholyte compartments, and wherein the secondary electrode is positioned such as to donate and/or divert plating current through the ionically resistive ionically permeable element.

In another aspect of the invention a method of electrochemically removing metal from an anodically biased substrate is provided, wherein the method includes: (a) providing the substrate into an apparatus configured for electrochemically removing metal from the surface of the substrate, wherein the apparatus comprises: (i) a chamber configured to contain an electrolyte, the chamber comprising a catholyte compartment and an anolyte compartment, wherein the anolyte compartment and the catholyte compartment are separated by an ion-permeable membrane; (ii) a substrate holder configured to hold the substrate in the anolyte compartment during electrochemical removal of metal; (iii) a primary cathode positioned in the catholyte compartment of the plating chamber; (iv) an ionically resistive ionically permeable element positioned between the ion-permeable membrane and the substrate holder, wherein the ionically resistive ionically permeable element is adapted to provide ionic transport through the element during electrochemical metal removal; and (v) a secondary electrode configured to donate and/or divert ionic current to the substrate and/or from the substrate, wherein the secondary electrode is positioned such that the donated and/or diverted ionic current does not cross the ion-permeable membrane separating the anolyte and catholyte compartments and wherein the secondary electrode is positioned such as to donate and/or divert ionic current through the ionically resistive ionically permeable element; (b) electrochemically removing the metal from the positively biased substrate, while providing power to the secondary electrode and the primary cathode. The method may further include rotating the substrate during metal removal.

In another aspect of the invention an apparatus for electrochemically removing metal from a positively biased substrate is provided, wherein the apparatus includes (a) a chamber configured to contain an electrolyte, the chamber comprising a catholyte compartment and an anolyte compartment, wherein the anolyte compartment and the catholyte compartment are separated by an ion-permeable membrane; (b) a substrate holder configured to hold the positively biased substrate in the anolyte compartment during electroplating; (c) a primary cathode positioned in the anolyte compartment of the plating chamber; (d) an ionically resistive ionically permeable element positioned between the ion-permeable membrane and the substrate holder, wherein the ionically resistive ionically permeable element is adapted to provide ionic transport through the element during electrochemical material removal; and (e) secondary electrode configured to donate and/or divert ionic current to the substrate and/or from the substrate, wherein the secondary electrode is positioned such that the donated and/or diverted ionic current does not cross the ion-permeable membrane separating the anolyte and catholyte compartments and does not cross the ionically resistive ionically permeable element. In some embodiments, in accordance with this aspect, the secondary electrode is an azimuthally symmetric secondary cathode.

In another aspect of the invention a method of electrochemically removing a metal from an anodically biased substrate is provided, wherein the method includes: (a) providing the substrate into an apparatus configured for electrochemically removing metal from an anodically biased substrate, wherein the apparatus comprises: (i) a chamber configured to contain an electrolyte, the chamber comprising a catholyte compartment and an anolyte compartment, wherein the anolyte compartment and the catholyte compartment are separated by an ion-permeable membrane; (ii) a substrate holder configured to hold the substrate in the anolyte compartment during metal removal; (iii) a primary cathode positioned in the catholyte compartment of the chamber; (iv) an ionically resistive ionically permeable element positioned between the ion-permeable membrane and the substrate holder, wherein the ionically resistive ionically permeable element is adapted to provide ionic transport through the element during electrochemical removal of the metal; and (v) a secondary electrode configured to donate and/or divert ionic current to the substrate and/or from the substrate, wherein the secondary electrode is positioned such that the donated and/or diverted ionic current does not cross the ion-permeable membrane separating the anolyte and catholyte compartments and does not cross the ionically resistive ionically permeable element; (b) electrochemically removing the metal from the positively biased substrate, while providing power to the secondary electrode and the primary cathode.

The invention claimed is:

1. An electroplating apparatus for electroplating a metal on a substrate, the apparatus comprising:

(a) a plating chamber configured to contain an electrolyte, the plating chamber comprising a catholyte compartment and an anolyte compartment, wherein the anolyte compartment and the catholyte compartment are separated by an ion-permeable membrane;

(b) a substrate holder configured to hold and rotate the substrate in the catholyte compartment during electroplating;

(c) a primary anode positioned in the anolyte compartment of the plating chamber;

(d) an ionically resistive ionically permeable element positioned between the ion-permeable membrane and the substrate holder, wherein the ionically resistive ionically permeable element is adapted to provide ionic transport through the element during electroplating; and (e) a secondary anode configured to donate plating current to the substrate, wherein the secondary anode is positioned such that the donated plating current does not cross the ion-permeable membrane separating the anolyte and catholyte compartments, and wherein the secondary anode is positioned such as to donate plating current through the ionically resistive ionically permeable element, wherein the ionically resistive ionically permeable element comprises at least three portions: (i) an outer, ionically permeable portion; (ii) a middle, ionically impermeable portion; and (iii) an inner, ionically permeable portion, wherein the apparatus is configured to donate plating current from the secondary anode through the outer, ionically permeable portion, but not through the inner ionically permeable portion.

2. The apparatus of claim 1, wherein the secondary anode is an azimuthally symmetrical anode.

3. The electroplating apparatus of claim 2, wherein the primary anode has a diameter or width that is smaller than a diameter or width of a plating face of the substrate.

4. The electroplating apparatus of claim 2, wherein a portion of the plating chamber housing the primary anode has a diameter or width that is smaller than a diameter or width of a plating face of the substrate.

5. The apparatus of claim 2, wherein the secondary anode is positioned in a secondary anode compartment, around the periphery of the plating chamber.

6. The apparatus of claim 2, wherein the secondary anode compartment is separated from the catholyte compartment by an ion-permeable membrane.

7. The apparatus of claim 2, wherein the secondary anode is a consumable anode.

8. The apparatus of claim 2, wherein the secondary anode is a consumable anode comprising copper.

9. The apparatus of claim 2, wherein the secondary anode is an inert anode.

10. The apparatus of claim 2, wherein the ionically resistive ionically permeable element is separated from a plating surface of the substrate by a gap of 10 mm or less.

11. The apparatus of claim 10, further comprising an inlet to the gap for introducing electrolyte flowing to the gap and an outlet to the gap for receiving electrolyte flowing through the gap, wherein the inlet and the outlet are positioned proximate azimuthally opposing perimeter locations of a plating face of the substrate, and wherein the inlet and outlet are adapted to generate cross-flow of electrolyte in the gap.

12. The apparatus of claim 2, wherein the secondary anode is positioned in a secondary anode compartment, and wherein the apparatus comprises one or more channels for irrigating the secondary anode in the secondary anode compartment.

13. The apparatus of claim 2, wherein the secondary anode is positioned in a secondary anode compartment, and wherein the apparatus comprises one or more channels for collecting and removing bubbles from the secondary anode compartment.

14. The apparatus of claim 2, wherein the ionically resistive ionically permeable element is azimuthally asymmetric and comprises an azimuthally asymmetrically positioned portion that does not allow the plating current to pass through the ionically resistive ionically permeable element.

15. The apparatus of claim 1, wherein the middle, ionically impermeable portion of the ionically resistive ionically permeable element has a smaller surface on a side of the ionically resistive ionically permeable element that is closest to the substrate than on the opposite side of the element.

16. The apparatus of claim 1, wherein the apparatus is configured to dynamically control the secondary anode during electroplating.

17. A method of electroplating a metal on a cathodically biased substrate, the method comprising:

(a) providing the substrate into an electroplating apparatus configured for rotating the substrate during electroplating, wherein the apparatus comprises:

(i) a plating chamber configured to contain an electrolyte, the plating chamber comprising a catholyte compartment and an anolyte compartment, wherein the anolyte compartment and the catholyte compartment are separated by an ion-permeable membrane;

(ii) a substrate holder configured to hold and rotate the substrate in the catholyte compartment during electroplating;

(iii) a primary anode positioned in the anolyte compartment of the plating chamber;

(iv) an ionically resistive ionically permeable element positioned between the ion-permeable membrane and the substrate holder, wherein the ionically resistive ionically permeable element is adapted to provide ionic transport through the element during electroplating and wherein the ionically resistive ionically permeable element comprises at least three portions: an outer, ionically permeable portion; a middle, ionically impermeable portion; and an inner, ionically permeable portion;

and (v) a secondary anode configured to donate plating current to the substrate, wherein the secondary anode is positioned such that the donated plating current does not cross the ion-permeable membrane separating the anolyte and catholyte compartments and wherein the secondary anode is positioned such as to donate plating current through the ionically resistive ionically permeable element;

(b) electroplating the metal on the substrate while rotating the substrate, and while providing power to the secondary anode and the primary anode, wherein the donated plating current from the secondary anode passes through the outer, ionically permeable portion of the ionically resistive ionically permeable element, but not through the inner ionically permeable portion.

18. The method of claim 17, further comprising:

(c) after electroplating metal on the substrate, electroplating metal on a second substrate that has a different distribution of recessed features in an outer portion of the second substrate than the substrate, without substituting any mechanical shields in the apparatus.

* * * * *